US009145694B2

(12) United States Patent
Bulley

(10) Patent No.: US 9,145,694 B2
(45) Date of Patent: Sep. 29, 2015

(54) PLATFORM SUPPORT STRUCTURES AND PLATFORM ASSEMBLIES

(75) Inventor: Dan Bulley, British Columbia (CA)

(73) Assignee: Quick Products Inc., Kelowna, BC (CA)

( * ) Notice: Subject to any disclaimer, the term of this patent is extended or adjusted under 35 U.S.C. 154(b) by 0 days.

(21) Appl. No.: 12/504,393

(22) Filed: Jul. 16, 2009

(65) Prior Publication Data

US 2011/0012000 A1 Jan. 20, 2011

(51) Int. Cl.
*E04G 5/04* (2006.01)
*E04G 3/20* (2006.01)

(52) U.S. Cl.
CPC .. *E04G 3/20* (2013.01); *E04G 5/04* (2013.01); *E04G 5/048* (2013.01)

(58) Field of Classification Search
CPC ..... E04G 3/20
USPC ..... 182/82, 150; 256/65.11
See application file for complete search history.

(56) References Cited

U.S. PATENT DOCUMENTS

| | | | | | |
|---|---|---|---|---|---|
| 2,317,248 | A | * | 4/1943 | Brickman | 256/13.1 |
| 2,347,745 | A | * | 5/1944 | McKinney | 182/113 |
| 2,496,057 | A | * | 1/1950 | Lombard et al. | 248/238 |
| 2,882,101 | A | * | 4/1959 | Michalak et al. | 248/235 |
| 2,921,960 | A | * | 1/1960 | Kirstahler et al. | 562/564 |
| 3,767,010 | A | * | 10/1973 | Newlan et al. | 182/150 |
| 3,921,960 | A | * | 11/1975 | Bright | 256/65.12 |
| 4,372,425 | A | * | 2/1983 | Murphy | 182/186.9 |
| 4,428,457 | A | | 1/1984 | Fikkers | |
| 4,453,619 | A | * | 6/1984 | Bierman | 182/142 |
| 4,509,617 | A | * | 4/1985 | Lapeyre | 182/93 |
| 4,809,941 | A | * | 3/1989 | Sheridan | 248/249 |
| 4,966,341 | A | * | 10/1990 | Borsani | 248/165 |
| 4,979,725 | A | * | 12/1990 | Hutchings et al. | 256/64 |
| 5,158,023 | A | * | 10/1992 | Allen | 108/42 |
| 5,203,426 | A | | 4/1993 | Sydnor | |
| 5,314,167 | A | * | 5/1994 | Holloman | 256/69 |
| 5,472,164 | A | * | 12/1995 | Contee, Jr. | 248/214 |
| 5,503,358 | A | | 4/1996 | Lapp | |
| 5,601,154 | A | | 2/1997 | Eisenmenger | |
| 5,622,463 | A | * | 4/1997 | Testa | 409/131 |
| 5,647,451 | A | * | 7/1997 | Reichel | 182/45 |
| 5,829,549 | A | * | 11/1998 | Flynn | 182/82 |
| 5,878,838 | A | | 3/1999 | Lapp | |
| 6,003,631 | A | * | 12/1999 | Knauth | 182/82 |
| 6,026,932 | A | | 2/2000 | Comp | |
| 6,131,698 | A | | 10/2000 | Reyland | |
| 6,220,390 | B1 | | 4/2001 | Pike | |
| 6,302,238 | B1 | | 10/2001 | Preusser et al. | |
| 6,340,070 | B1 | | 1/2002 | Villareal, Jr. et al. | |
| 6,422,339 | B1 | * | 7/2002 | Wisler | 182/82 |
| 6,494,291 | B2 | | 12/2002 | Ono | |
| 6,536,734 | B1 | | 3/2003 | Brijmohan et al. | |
| 6,722,468 | B2 | | 4/2004 | Albano | |

(Continued)

FOREIGN PATENT DOCUMENTS

JP 05059809 A * 3/1993

*Primary Examiner* — Alvin Chin-Shue
(74) *Attorney, Agent, or Firm* — Wells St. John P.S.

(57) ABSTRACT

This invention includes a platform support structure having a support extension and a fastening device extending from the support extension. The support extension has a surface to support a platform adjacent a structure. The fastening device is configured to secure the support extension to the structure. Moreover, the fastening device includes a slide bar and a clamp in sliding engagement with the slide bar.

6 Claims, 18 Drawing Sheets

(56) References Cited

U.S. PATENT DOCUMENTS

| | | | | |
|---|---|---|---|---|
| 6,799,658 | B2 | 10/2004 | Cogar et al. | |
| 6,886,662 | B2 * | 5/2005 | Riley | 182/82 |
| 6,931,998 | B1 * | 8/2005 | Leese | 108/42 |
| 6,945,358 | B2 | 9/2005 | Albano | |
| 7,114,296 | B2 | 10/2006 | Klassen et al. | |
| 7,228,936 | B2 | 6/2007 | Wyse et al. | |
| 7,264,083 | B2 | 9/2007 | Wilcox | |
| 7,353,911 | B1 * | 4/2008 | Freeman | 182/129 |
| 8,181,742 | B1 * | 5/2012 | Ranese et al. | 182/146 |
| 8,595,989 | B1 * | 12/2013 | Greene | 52/82 |
| 2002/0139614 | A1 * | 10/2002 | Volkman | 182/82 |
| 2003/0019985 | A1 | 1/2003 | Rogers | |
| 2003/0146049 | A1 * | 8/2003 | Albano | 182/150 |
| 2004/0159491 | A1 | 8/2004 | Albano | |
| 2005/0199441 | A1 * | 9/2005 | Thery | 182/82 |
| 2006/0163001 | A1 * | 7/2006 | Pozell | 182/82 |
| 2006/0175130 | A1 * | 8/2006 | Riley | 182/82 |
| 2006/0249721 | A1 * | 11/2006 | Landaker et al. | 256/59 |
| 2007/0056799 | A1 * | 3/2007 | Leidner | 182/82 |
| 2007/0193832 | A1 * | 8/2007 | Dangrow et al. | 182/204 |

* cited by examiner

FIG. II

PLATFORM SUPPORT STRUCTURES AND PLATFORM ASSEMBLIES

CROSS REFERENCE TO RELATED APPLICATION

This application does not claim priority from any other application.

TECHNICAL FIELD

This invention relates to platform support structures and platform assemblies.

BACKGROUND OF THE INVENTION

Support platforms, support structures, platform support structures and support frames are used to form platform assemblies, such as in one example, scaffolding. Scaffolding is routinely used for supporting personnel and materials during construction, repair and maintenance of buildings and other erect structures. Some designs and configurations of platform assemblies are provided to rest upon a substrate adjacent an erect structure or building such as the ground or sidewalk. Alternative designs and configurations of platform assemblies are hung upon the erect structure or building.

However, there is a need to improve the designs and structure configurations for platform assemblies to increase the safety of personnel during use. Moreover, there is a need to improve the designs and structure configurations for platform assemblies to increase efficiency and simplicity of use. Still further, there is a need to improve the methods of constructing and supporting platform assemblies adjacent buildings and other erect structures.

BRIEF DESCRIPTION OF THE DRAWINGS

Preferred embodiments of the invention are described below with reference to the following accompanying drawings.

FIG. 12 is a perspective view of a second exemplary platform assembly according to another one of various embodiments of the invention.

FIG. 13 is a side view of an exemplary table support for an exemplary table assembly of the platform assembly of FIG. 12.

FIG. 14 is a front view of the table support of FIG. 13.

FIG. 15 is a top view of the table support of FIG. 13.

FIG. 16 is a perspective view of an exemplary table assembly according to one of various embodiments of the invention with an exemplary table shown in phantom.

FIG. 17 is a side view of the exemplary platform assembly of FIG. 12 and illustrated in use in a partial cutaway of a building according to one of various embodiments of the invention.

FIG. 18 is a perspective view of a third exemplary platform assembly according to still another one of various embodiments of the invention.

FIG. 19 is a perspective view of second exemplary platform support structure according to another one of various embodiments of the invention.

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

The terms "a", "an", and "the" as used in the claims herein are used in conformance with long-standing claim drafting practice and not in a limiting way. Unless specifically set forth herein, the terms "a", "an", and "the" are not limited to one of such elements, but instead mean "at least one".

Figure 1:
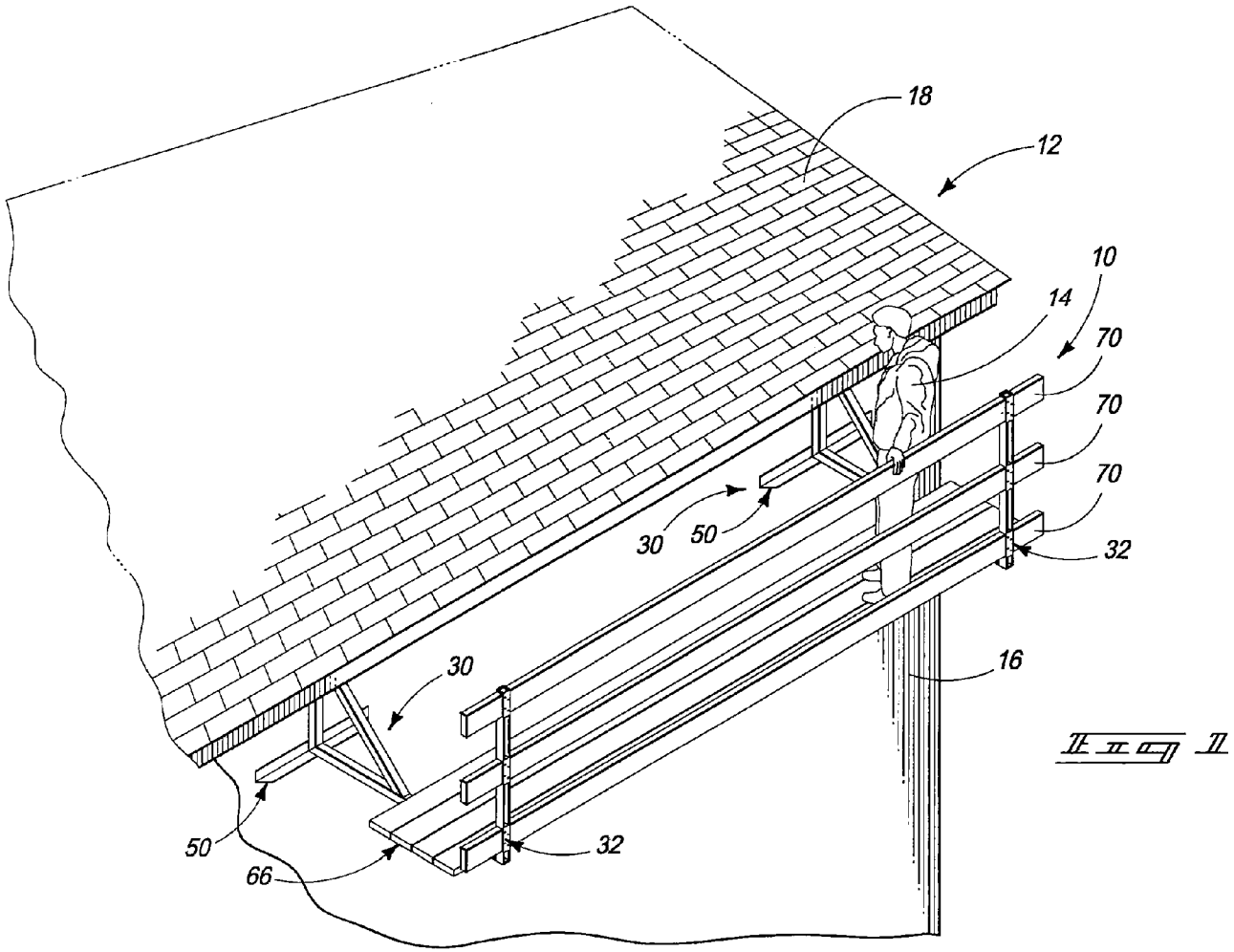
FIG. 1 is a perspective view of an exemplary platform assembly according to one of various embodiments of the invention and illustrated in use according to one of various embodiments of the invention.

Referring to FIG. 1, an exemplary platform assembly 10, and an exemplary method of using the platform assembly 10, is illustrated according to one of various embodiments of the invention. The exemplary platform assembly 10 is supported, in one exemplary fashion, on a wall 16 of a building 12 below a roof 18. In another exemplary embodiment of using platform assembly 10, platform assembly 10 can be suspended on spaced studs which are provided for the construction of wall 16. Alternatively, other exemplary methods of using platform assembly 10 are considered, for example, hanging platform assembly 10 on any structure capable of handling the weight of the platform assembly 10 including structures which are not buildings.

The exemplary platform assembly 10 illustrated includes laterally spaced platform supports (platform support structures) 30 arranged to position and support a platform (or floor or support surface) 66. In turn, at least one person 14 and/or materials are supported upon the platform 66. In this one exemplary embodiment, a pair of platform support structures 30 is provided laterally spaced from each other and supported or hung upon wall 16. Moreover, in this one exemplary embodiment of the invention, platform assembly 10 includes guard rails 70 to increase the safety of person 14 or personnel upon the platform assembly 10.

Figure 2:
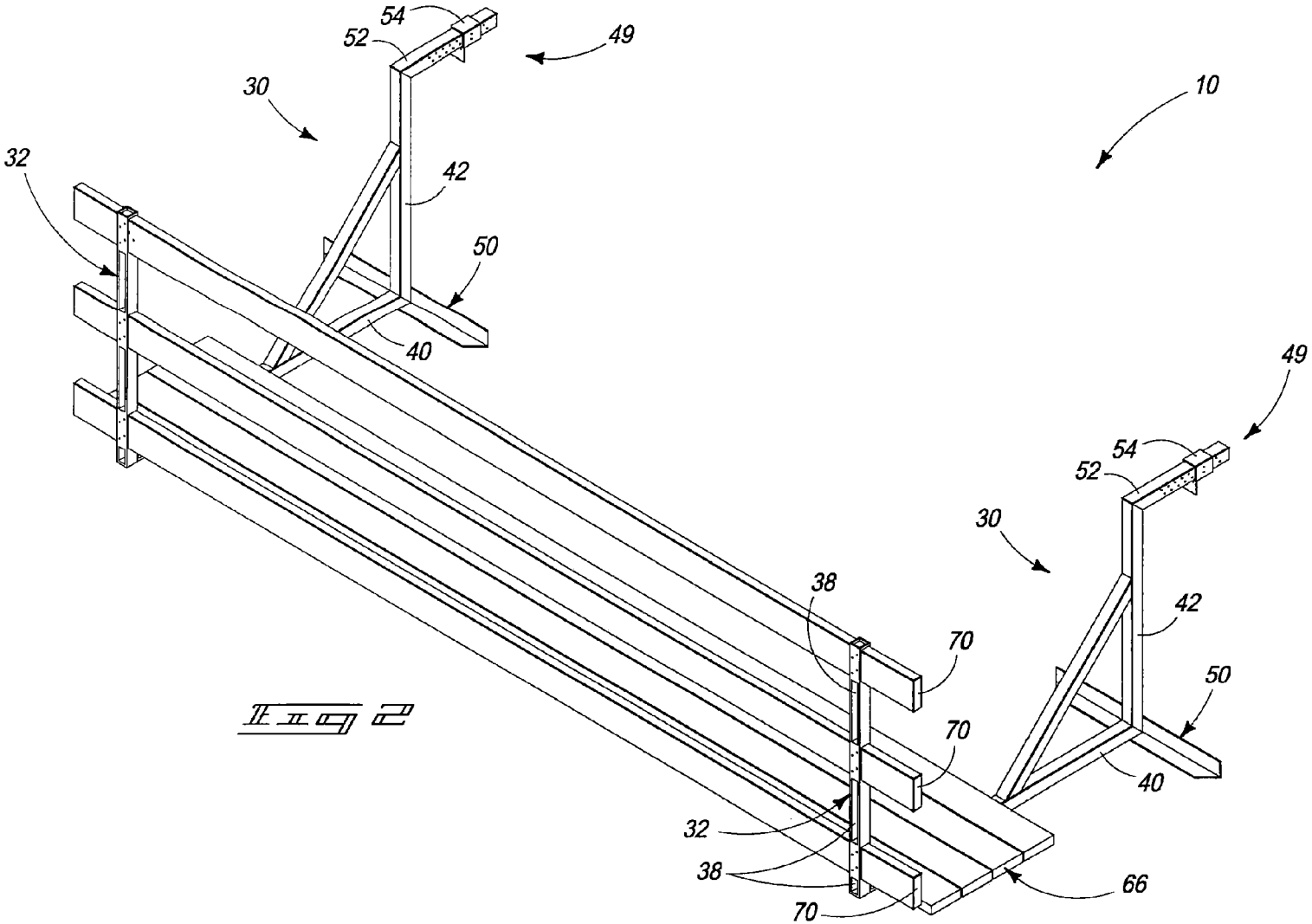
FIG. 2 is a different perspective view of the exemplary platform assembly of FIG. 1.

Referring to FIG. 2, the exemplary platform assembly 10 is illustrated according to one of various embodiments of the invention. Each platform support structure 30 includes a cross member or horizontal support (or support extension) 40 which receives and supports platform 66. Additionally, each platform support structure 30 includes a fastening device (or securement device) 49 to secure the platform assembly 10 to another structure. Furthermore, in one exemplary embodiment of each platform support structure 30, such includes an abutment plate 50 to provide additional stability and support of platform assembly 10 against the building or structure from which platform assembly 10 hangs and to protect the structure from which the platform assembly 10 hangs.

An exemplary embodiment of fastening device 49 according to one of various embodiments of the invention includes a slide bar 52 (or slide guide or guide bar) and a clamp device or clamp 54 (or sliding clamp or sliding brace) slidingly engaging the slide bar 52. The clamp 54 is additionally configured to be fixedly engaged with the slide bar 52 which is more thoroughly discussed subsequently. The exemplary platform support structure 30 includes a connection extension (or vertical support or vertical extension) 42 connecting the support extension (horizontal support) 40 and the fastening device 49. The fastening device 49 is elevationally above and extends generally parallel with support extension 40. Furthermore, fastening device 49 extends generally outwardly from the connection extension 40 in an opposite direction from which the support extension 40 extends from the connection extension 40. Each exemplary platform support structure 30 includes a rail post 32 having rail sockets 34 (see FIG. 3) as openings configured to receive the guard rails 70.

Still referring to FIG. 2, while the exemplary platform support structures 30 shown each have rail posts 32 with three rail sockets 34, other exemplary embodiments are considered. For example, other embodiments of platform supports structures 30 can include rail post 32 having only one rail socket 34, or having only two rail sockets 34, or having more than three rail sockets 34. Exemplary guard rails 70 can include planks of lumber. However, other exemplary materials for planks are considered, such as metal and plastics. Exemplary dimensions for guard rails 70 include the understanding that each rail socket 34 is configured to be dimensioned to receive the selected size of the guard rails 70. Alternatively, each end of the guard rails 70 such as a plank of lumber can be dimensioned to be received in selected dimensions of rail sockets 34. It should be understood that each pair of platform supports structures 30 can include one set of corresponding rail sockets 34 that have the same dimensions while another set of corresponding rail sockets 34 have different dimensions.

Still referring to FIG. 2, the plurality of guard rails 70 can be spaced elevationally above or below each other at any selected distance along the respective rail posts 32. For example, the spaced distances between respective guard rails 70 can be a range of spaced distances of: from about 0.0 inch to about 24.0 inches; from about 1 inch to about 20.0 inches; from about 2 inches to about 16.0 inches; from about 3 inches to about 12.0 inch; from about 4 inches to about 8 inches and an exemplary spaced distance being about 12 inches.

Moreover, the plurality of guard rails 70 can be selectively positioned and spaced from each other at the same respective differences for one embodiment of the platform assembly 10. Alternatively, the plurality of planks for guard rails 70 can be selectively positioned and spaced at different respective distances from each other for other embodiments of the platform assembly 10. Moreover, exemplary platform assemblies 10 include a plurality of guard rails 70 which range in number from only one to as many as twenty, and include any number of guard rails 70 in between. In one embodiment of the invention, the exemplary number of guard rails 70 for an exemplary guard rail 70 includes three planks of lumber, and each guard rail 70 is a plank of lumber such as a 2×4 having a length of about 12 feet.

It should be understood that exemplary guard rails 70 and exemplary platforms 66 according to embodiments of the invention include elongated and/or linear structures such as planks of lumber previously discussed. For example, guard rails 70 can include a 2×4 (two-by-four) piece of lumber that is finished or planed and cut to standardized depth and width. Other exemplary sizes for guard rails 70 are 1×2, 1×3, 1×4, 1×6, 1×8, 1×10, 1×12, 2×2, 2×3, 2×4, 2×6, 2×8, 2×10, 4×4, 4×6, 4×4, 6×6 and 8×8. Exemplary lengths for guard rails 70 include ranges of about 1 foot to about 30 feet, such as 4, 6, 8, 10, 12, 14, 16, 18, 20, 22, and 24 feet. It should be understood that if selected length dimensions of guard rails 70 are small, exemplary platform assemblies 10 may require additional platform supports 30.

Still other exemplary guard rails 70 and exemplary platforms 66 according to embodiments of the invention include compositions of material other than wood, such as metal, plastic or similar structure and material. For example, exemplary guard rails 70 and/or exemplary platforms 66 can be formed from any of a variety of materials such as plastics, thermoplastics, metals, metal alloys and any combination thereof. Exemplary metals or similar material include tin, iron, aluminum, magnesium, zinc and copper, and alloys of any one metal or any combination of the metals. The metals or similar material can be characterized as being ductile and/or malleable. Being ductile and malleable allows for the metal or similar material to be molded into various forms and hardened. Still other exemplary guard rails 70 and exemplary platforms 66 include alloys of metal such as steel, stainless steel, brass and bronze.

Yet other exemplary guard rails 70 and exemplary platforms 66 include structures comprising plastic such as thermoplastic, thermosetting plastic and similar material. These plastic materials can be characterized as being ductile and/or malleable which provides the capability of being molded into various forms and hardened. Furthermore, these plastic materials can be generally characterized by any of various nonmetallic compounds, synthetically produced, usually from organic compounds by polymerization, or formed into pliable sheets or films, fibers, flexible or hard foams. Example plastic materials include polystyrene, acrylonitrile butadiene styrene (ABS), polyamide, polypropylene, polyethylene, and polyvinyl chloride (PVC). Other exemplary nonmetallic compounds include spun glass or fiberglass which is a composite of extremely fine fibers of glass combined with polymers and epoxies.

Exemplary methods of forming exemplary embodiments of guard rails 70 and exemplary platforms 66 include injection molding. Injection molding is a manufacturing process using thermoplastic and/or thermosetting plastic materials described previously (example plastic materials include polystyrene, acrylonitrile butadiene styrene (ABS), polyamide, polypropylene, polyethylene, and polyvinyl chloride (PVC)). An overview of an injection molding process includes molten plastic being injected at high pressure into a mold wherein the mold is an inverse design of the shape of exemplary guard rails 70 and exemplary platforms 66. Still other exemplary methods of forming exemplary guard rails 70 and exemplary platforms 66 include die casting. Die casting is a manufacturing process using metals and/or metal alloys described previously (example metals or metal alloys include tin, iron, aluminum, magnesium, zinc and copper, and alloys of any one metal or any combination of the metals). An overview of a die casting process includes molten metal being injected at high pressure into a mold wherein the mold is an inverse design of the shape of exemplary guard rails 70 and exemplary platforms 66. Yet other exemplary methods of forming exemplary guard rails 70 and exemplary platforms 66 include: permanent mold casting, extrusion, forging, sand casting, powder metallurgy, ceramic mold casting, plaster mold casting and centrifugal casting.

Moreover, surface portions of exemplary guard rails 70 and exemplary platforms 66 can have any surface configuration such as a smooth planar surface or any rough surface. An exemplary rough surface includes a perforated surface, a surface with ridges, a surface with divots, and any rough surface to provide surface friction and traction, and any combination of these surface configurations. That is, exemplary surface portions of exemplary guard rails 70 and exemplary platforms 66 can have any of a variety of surface configurations from a planar surface to an extremely rough surface and any surface configuration in between the two extremes. Furthermore, exemplary guard rails 70 and exemplary platforms 66 can have geometric shapes other than rectangular, for example, oval, diamond and any polygonal shape.

Still referring to FIG. 2, an exemplary platform 66 of an exemplary platform assembly 10 includes a plurality of planks of lumber and/or linear structures having any selected dimensions. Moreover, it should be understood that the plurality of linear structures for platform 66 can be positioned substantially adjacent one another with respective sides (with height dimensions) against each other. Alternatively, in other embodiments of the invention, linear structures for platform 66 can be positioned adjacent one another side by side, but not against one another, with a space between respective sides. The spacing between linear structures can be at any selected lateral distance. For example, a spaced distance between respective linear structures of platform 66 can be a range of spaced distances: from about 1/64 inch to about 2.5 inches; from about 1/32 inch to about 2.0 inches; from about 1/16 inch to about 1.5 inches; from about 1/8 inch to about 1 inch; from about 1/4 inch to about 3/4 inch and an exemplary spaced distance being about 1/2 inch. For other embodiments of the invention, the plurality of linear structures for platform 66 can be selectively positioned and spaced from each other at different respective distances relative each other. For example, one pair of linear structures of an exemplary platform 66 can be spaced a first distance apart with another linear structure adjacent the pair of linear structures is spaced a second distance that is different from the first distance.

Still referring to FIG. 2, an exemplary platform 66 for an inventive platform assembly 10 includes a plurality of linear structures which range in number from only one to eight, or any number of linear structures between one and eight, and include up to at least a total of twenty linear structures or more. In one embodiment of the invention, the exemplary number of linear structures for an exemplary platform 66 includes three or four planks of lumber and each plank of lumber is a 2×8 piece of lumber having a length of about 12 feet. It should be understood that other dimensions for linear structures of platform 66 could be used with an exemplary deciding factor being the job for which the inventive platform assembly 10 is to be used.

Additionally, it should be understood that platform assembly 10, according to various embodiments of the invention, can be used either alone or in combination with other platform assemblies 10. For example, platform assemblies 10 can be positioned side by side with respective platforms 66 oriented adjacent each other generally in the same plane and end to end. Furthermore, another exemplary platform 66 includes a single, one-piece structure having any selected dimensions. It should be understood that exemplary platforms 66, whether a single structure or a plurality of structures, can be formed from any of a variety of materials such as plastics, thermoplastics, metals, metal alloys and any combination thereof previously discussed. The exemplary methods of forming exemplary embodiments of exemplary platforms 66 were also previously discussed.

Figure 3:
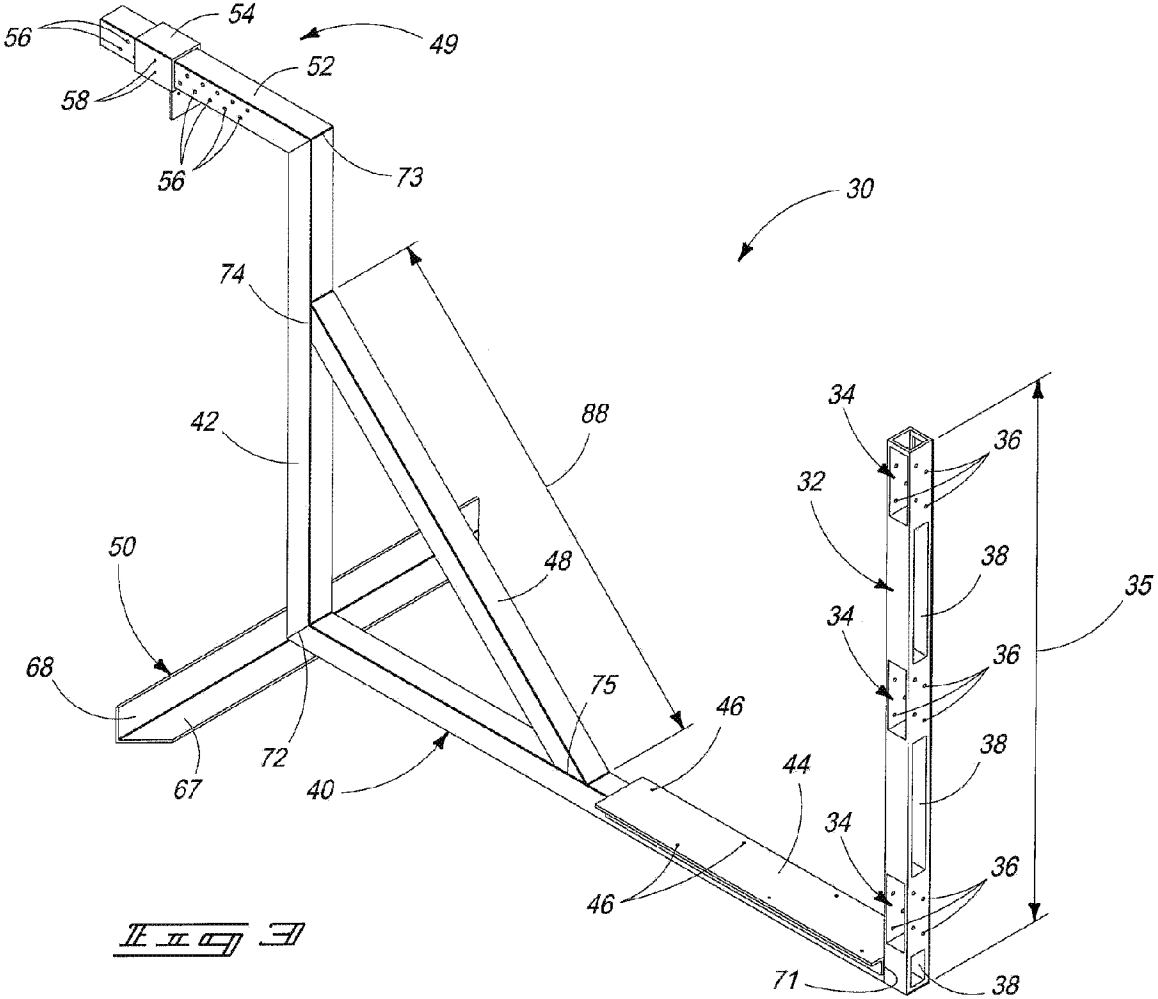
FIG. 3 is a perspective view of an exemplary platform support structure according to one of various embodiments of the invention.
Figures 4, 4A, 4B, 4C:
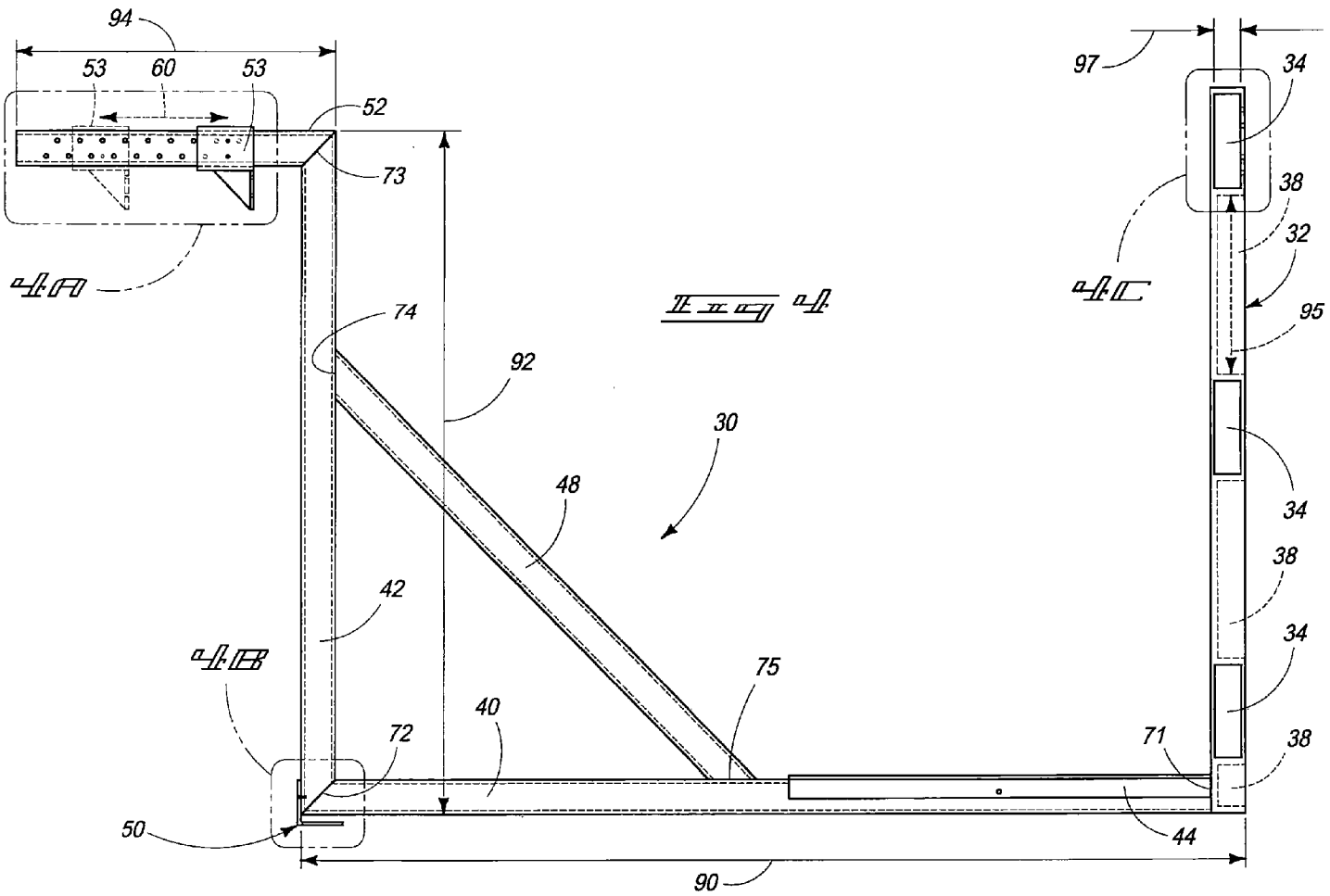
FIG. 4 is a side view of the exemplary platform support structure of FIG. 3.
FIG. 4A is a breakaway view of FIG. 4 of an exemplary fastening device according to one of various embodiments of the invention.
FIG. 4B is a breakaway view of FIG. 4 of an exemplary abutment plate according to one of various embodiments of the invention.
FIG. 4C is a breakaway view of FIG. 4 of an exemplary rail post according to one of various embodiments of the invention.

Referring to FIGS. 3-4, an exemplary platform support structure 30 is illustrated according to one of various embodiments of the invention. Platform support structure 30 includes rail post 32 connected to horizontal support (support extension) 40 at a joint 71. An exemplary joint 71 is a right angle joint; however, angles other than 90 degrees are possible for joint 71. Support extension 40 is connected to connection extension 42 at a joint 72. An exemplary joint 72 is a right angle joint; however, angles other than 90 degrees are possible for joint 72. Connection extension 42 is connected to slide bar 52 of fastening device 49 at a joint 73. An exemplary joint 73 is a right angle joint; however, angles other than 90 degrees are possible for joint 73. One exemplary platform support structure 30 includes an angled brace 48 that extends over joint 72 and secures connection extension 42 and support extension 40 at joints 74 and 75, respectively. Exemplary joints 74 and 75 comprise 45 degrees in one embodiment; however, angles other than 90 degrees are possible for joints 74 and 75 such as 30 degrees and 60 degrees, respectively (or the reverse). Another exemplary platform support structure 30 includes a platform plate 44 secured over a portion of the support extension 40 between joints 71 and 75. Still another exemplary embodiment of the invention, platform support structure 30 does not include a platform plate 44.

In one embodiment for an exemplary platform support structure 30, each joint 71-75 fixedly joins or connects the two respective components together without the capability of being separated. That is, the exemplary platform support structure 30 has no components that can be separated from other components (e.g., rail post 32, support extension 40, connection extension 42, angled brace 48 and slide bar 52) at the respective joints. For example, rail post 32 is fixedly connected to support extension 40 by, for example, a weld between rail post 32 and support extension 40 forming joint 71. It should be understood that any exemplary platform assembly and any exemplary platform support structure described in this document (not including the Background of the Invention section) can have this exemplary configuration for the exemplary platform support structure.

Alternatively, another embodiment of an exemplary platform support structure 30 includes at least one of the components (e.g., at least one of rail post 32, support extension 40, connection extension 42, angled brace 48 and slide bar 52) being capable of being selectively separated, and reconnected, to platform support structure 30. That is, one of the components of platform support structure 30 is selectively separated and reconnected from other components of the platform support structure 30. For example, in this configuration of platform support structure 30, rail post 32 is capable of being selectively separated and reconnected to support extension 40 at joint 71. An exemplary configuration of joint 71 to provide this capability is with either rail post 32 or support extension 40 having an end portion capable of being positioned inside the other component. To finalize this configuration, each of rail post 32 and support extension 40 will have openings that can be aligned and then receive a set pin to position the two components in a fixed relationship forming joint 71. It should be understood that any exemplary platform assembly and any exemplary platform support structure described in this document (not including the Background of the Invention section) can have this exemplary configuration for the exemplary platform support structure.

Still further, another embodiment of an exemplary platform support structure 30 includes all of the components (e.g., rail post 32, support extension 40, connection extension 42, angled brace 48 and slide bar 52) being capable of being selectively disconnected (separated), and selectively reconnected, to platform support structure 30. In this configuration, the entire platform support structure 30 can be broken down into linear components (e.g., each of rail post 32, support extension 40, connection extension 42, angled brace 48 and slide bar 52) and packed in a compact volume all aligned to extend adjacent each other. This configuration of the platform support structure 30 facilitates ease of packing and transporting the platform assembly 10, ease of assembling the platform assembly 10, and ease of disassembling the platform assembly 10. Furthermore, when disassembling this exemplary platform support structure 30, any order of disassembling any two components can be selected to be separated. Conversely, when assembling this exemplary platform support structure 30, any order of assembling any two components can be selected to be connected. This capability is beneficial for selectively modifying the order of assembling and disassembling the platform assembly 10 based on the type of structure for which the platform assembly 10 will be supported upon. It should be understood that any exemplary platform assembly and any exemplary platform support structure described in this document (not including the Background of the Invention section) can have this exemplary configuration for the exemplary platform support structure.

Furthermore, another embodiment of an exemplary platform support structure 30 includes the capability of having length dimensions selectively modified for at least one of the components (e.g., rail post 32, support extension 40, connection extension 42, angled brace 48 and slide bar 52). For example, support extension 40 can be configured to have a length dimension that is selectively increased and/or selectively decreased. In this configuration, if the platform assembly 10 needs additional width for a wider or larger platform 66 surface area, the length of the support extension 40 can be increased to receive a wider platform 66. A design to allow this capability is, for example, the support extension 40 having a telescopic configuration. That is, the support extension 40 is configured as having two distinct and separate portions. One portion is configured to slide inside, and outside, the other portion allowing for the total length of the support extension 40 to be selectively increased or decreased. Additionally, each of the two portions will have openings that can be aligned at the selected length for the support extension 40, and then a set pin is positioned in the two aligned openings to provide the two portions in a fixed relationship.

In one embodiment of an exemplary platform assembly 10, any one of the components (e.g., rail post 32, support extension 40, connection extension 42, angled brace 48 and slide bar 52) will have the capability of having length dimensions selectively modified (increased or decreased). In yet another embodiment of an exemplary platform assembly 10, all the components (e.g., rail post 32, support extension 40, connection extension 42, angled brace 48 and slide bar 52) will have the capability of having length dimensions selectively modified (increased or decreased). Additionally, it should be understood that any exemplary platform assembly and any exemplary platform support structure described in this document (not including the Background of the Invention section) can have this exemplary configuration for the exemplary platform support structure.

Still referring to FIGS. 3-4, exemplary dimensions are disclosed for one exemplary embodiment of platform support structure 30. Rail post 32, support extension 40, connection extension 42, angled brace 48 and slide bar 52 are each a hollow square tube configuration. Each hollow square tube configuration has a cross section of four equal-dimensioned outermost sides and each outermost side measures approximately 2¼ inches. Wall thicknesses for the hollow square tube configurations will vary. For example, wall thicknesses for support extension 40, connection extension 42 and slide bar 52 measure approximately ¼ inch. Wall thicknesses for the angled brace 48 and rail post 32 are greater to increase integrity of rail post 32. An exemplary length dimension 35 for rail post 32 is approximately 47 inches. An exemplary length dimension 88 for angled brace 48 is approximately 39⅖ inches. An exemplary length dimension 90 for support extension 40 is approximately 62 inches. An exemplary length dimension 92 for connection extension 42 is approximately 44 inches. An exemplary length dimension 94 for slide bar 52 is approximately 21 inches.

Still referring to FIGS. 3-4, an exemplary length dimension 96 for rail sockets 34 is approximately 6 inches. An exemplary width dimension 97 for rail sockets 34 is approximately ¼ inches. An exemplary lateral wall thickness 98 for rail sockets 34 is approximately 3/10 inch. An exemplary length dimension 95 for openings 38 is approximately 12 inches. An exemplary lateral wall thickness 99 for openings 38 is approximately 7/16 inch. An exemplary thickness dimension 81 of abutment plate 50 is approximately ¼ inch. An exemplary width dimension 82 for first rectangular plate 67 of abutment plate 50 is approximately 3 inches. An exemplary width dimension 86 for second rectangular plate 68 of abutment plate 50 is approximately 3 inches. An exemplary distance 91 between support extension 40 and first rectangular plate 67 of abutment plate 50 is approximately ¾ inch.

Referring to FIGS. 4 and 4A, an exemplary embodiment of the fastening device 49 includes slide bar 52 having a first row 78 of adjustment openings 56 that are spaced from a second row 80 of adjustment openings 56. It should be noted that in this one embodiment, adjustment openings 56 of the first row 78 are offset (or staggered) in vertical relation to the adjustment openings 56 of the second row 80. This configuration of adjustment openings 56 allows for a greater number of possible incrementally fixed positions for sliding structure 53 (referenced more commonly as clamp 54 when set pin 63 included in sliding structure 53 (see FIGS. 7-9)) along slide bar 52. Sliding structure 53 has a pair of vertically spaced and aligned apertures 58. In another embodiment of sliding structure 53, the two apertures 58 are not aligned. The spacing of apertures 58 is configured to allow for one aperture 58 to be aligned with the first row 78 of adjustment openings 56 of slide bar 52 and the other aperture 58 to be aligned with the second row 80 of adjustment openings 56. Sliding structure 53 can selectively slide along slide bar 52 in both directions represented by arrow 60. Fixed engagement of sliding structure 53 with slide bar 52 is described more thoroughly subsequently.

Referring to FIGS. 4 and 4B, another embodiment of the invention includes the platform support structure 30 having an abutment plate 50 secured to connection extension 42 and/or support extension 40 over the outside of joint 72. An exemplary embodiment of an abutment plate 50 is configured as a first rectangular plate 67 extending perpendicularly from a second rectangular plate 68. Exemplary securement methods of abutment plate 50 to either connection extension 42 or support extension 40 include a weld or a fastener, or both. Exemplary fasteners for abutment plate 50 include a bolt 51, screw and/or a rivet. In one embodiment of the invention, the second rectangular plate 68 of abutment plate 50 is secured to the connection extension 42 by bolt 51 with the first rectangular plate 67 spaced from, and generally parallel with, the bottom surface of support extension 40. An alternative embodiment of abutment plate 50 would be devoid of first rectangular plate 67 leaving only second rectangular plate 68 to rest or abut against a structure for which platform assembly 10 is supported upon. Still further, another exemplary embodiment of platform support structure 30 does not include an abutment plate 50.

Still referring to FIGS. 4 and 4B, exemplary embodiments of abutment plate 50 are configured to allow the inventive platform support structure 30 to rest against any structure, including a wall, or studs for a wall (e.g., building in construction) which would be spaced from each other. That is, the exemplary embodiments of abutment plate 50 will have length dimensions to rest against spaced studs (or vertical framing members) for a wall to increase stability of the platform assembly 10. Accordingly, the abutment plate 50 would be configured to span any gap between one stud and an adjacent stud. Alternatively, the abutment plate 50 can be configured to rest or abut against a single stud, and therefore, the length dimension can be small. An exemplary range of gaps or spacing between studs or framing structures for the abutment plate 50 to span include from about one inch to about 36 inches. The length dimension of the abutment plate 50 can be selected to suit the particular circumstances and ensure that the lower end of the connection extension 42 of the inventive platform assemblies 10 is braced against the studs of the wall. In addition, use of the abutment plate 50 distributes the force exerted by the lower end of the hanging platform support structure 30 of platform assembly 10 over multiple studs of a wall to which the platform assembly 10 is attached. An exemplary length dimension for the abutment plate 50 is at least 36 inches to distribute the force exerted by the lower end of platform assemblies 10 over more than two studs, for example, at least three studs.

Referring to FIGS. 4 and 4C, an exemplary embodiment of the rail post 32 of an exemplary platform support structure 30 according to the invention is more thoroughly described. The exemplary rail post 32 is a rectangularly-configured post extending generally perpendicularly to support extension 40 and generally parallel to connection extension 42. Rail post 32 has a generally a square cross-section configuration. Other cross-sectional configurations are possible, for example, square, oval, circular, diamond or any other polygonal shape. The exemplary rail post 32 includes at least one rail sockets 34 with three shown. Exemplary rail sockets 34 extend entirely through the structure of the rail post 32. Other embodiments of rail sockets 34 extend only partially through the structure of the rail post 32.

Still referring to FIGS. 4 and 4C, exemplary rail post 32 includes at least one additional opening 38 other than the rail sockets 34. In the embodiment shown, rail post 32 includes three openings 38. Exemplary openings 38 extend only partially through the structure of the rail post 32 and generally in a direction perpendicular to rail sockets 34. Openings 38 extend from the surface of rail post 32 opposite the support extension 40 and into the structure of the rail post 32 toward the connection extension 42. While the plurality of openings 38 can have the same dimensions, openings 38 shown have different dimensions, and any number of openings 38 can be included in various embodiments of rail posts 32. In another embodiment of the invention, openings 38 extend from the surface of rail post 32 facing the connection extension 42 and can have the same dimensions or different dimensions. At least one reason for providing openings 38 is to lessen the weight of exemplary platform support structures 30 and platform assemblies 10. In still other embodiments of the invention, rail posts 32 do not include openings 38.

Figure 5:
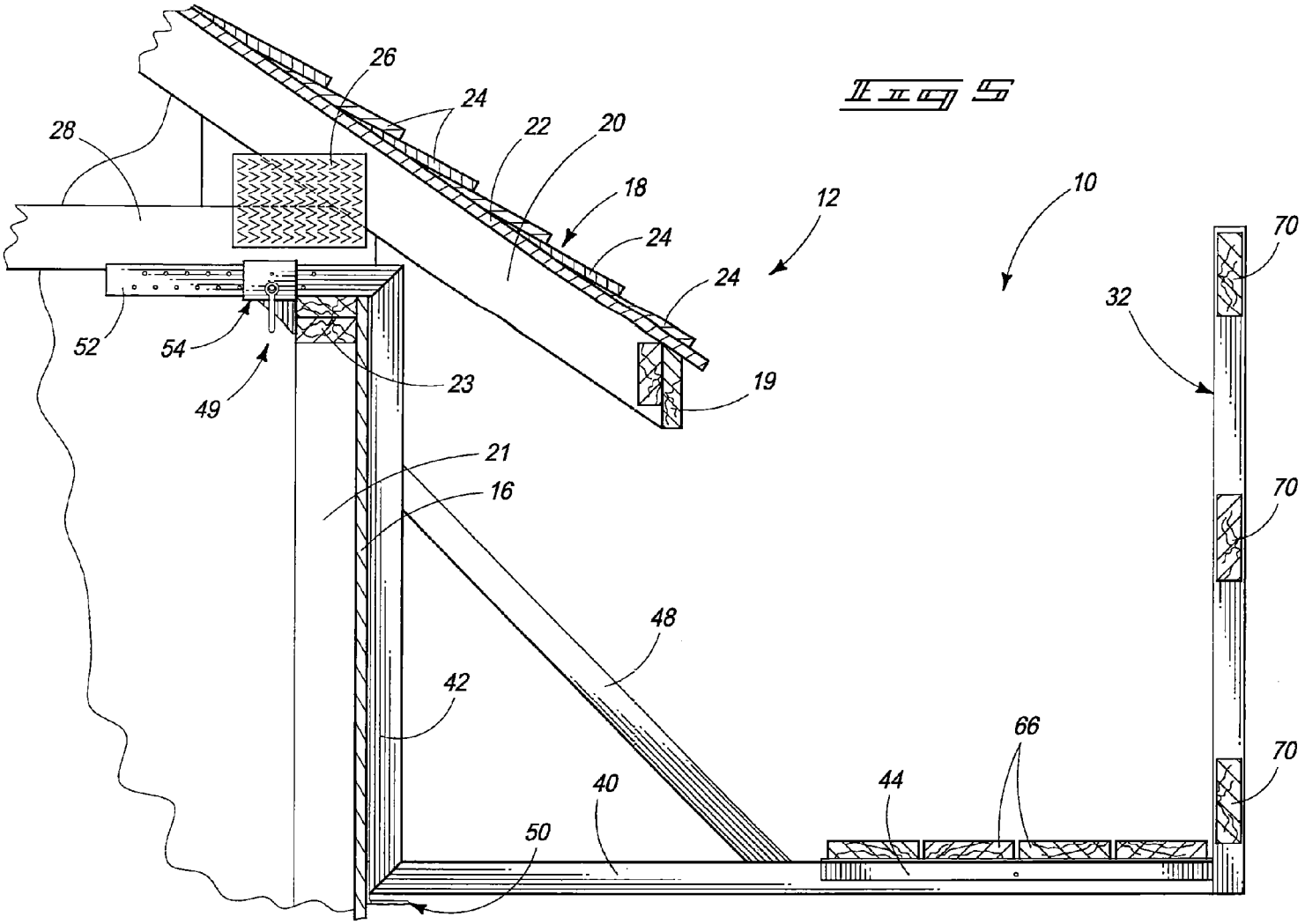
FIG. 5 is a side view of the exemplary platform assembly of FIG. 1 and illustrated in use in a partial cutaway of a building according to one of various embodiments of the invention.
Figure 6:
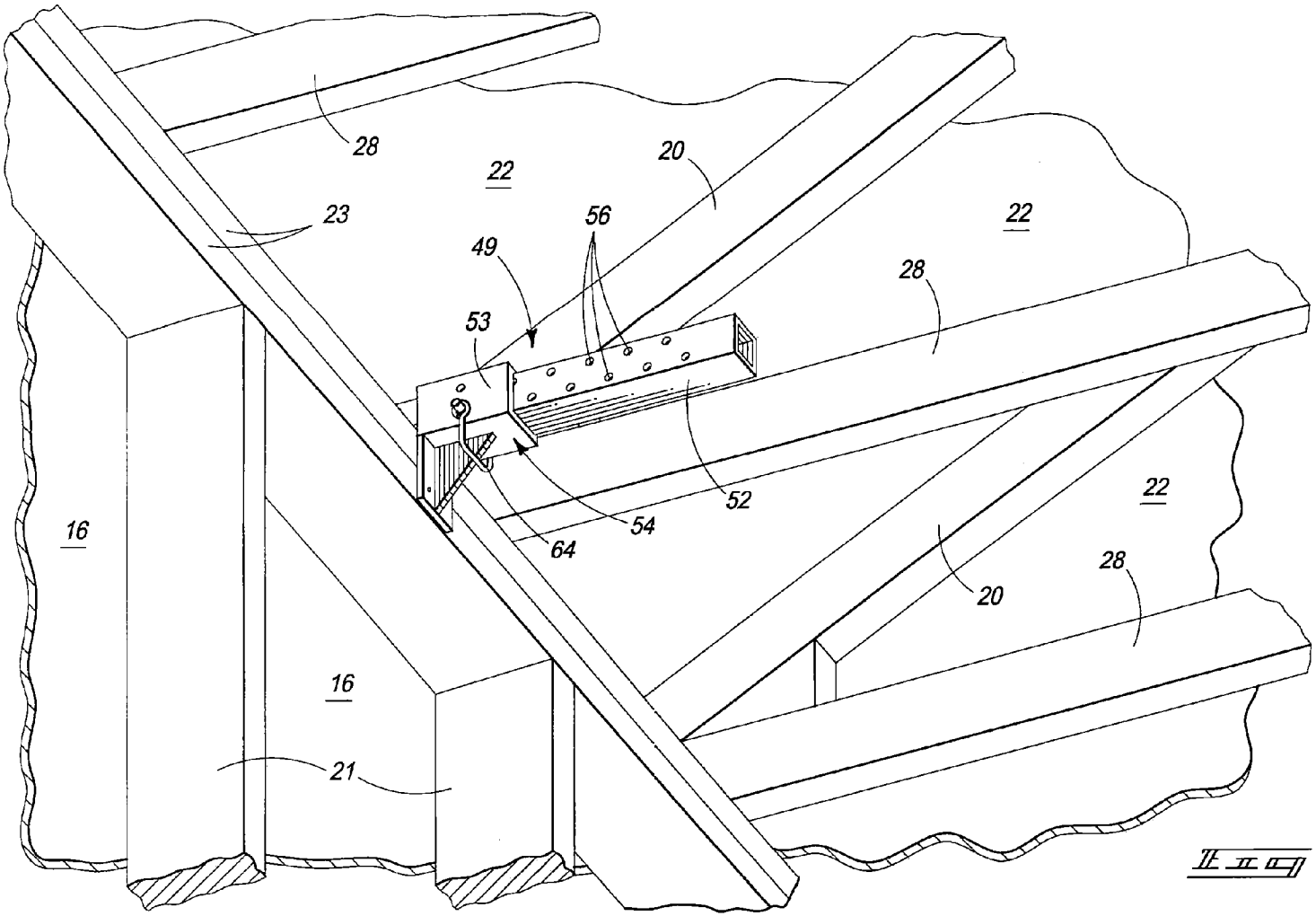
FIG. 6 is a partial perspective view of FIG. 5 emphasizing the exemplary fastening device.

Referring to FIGS. 5-6, an exemplary platform assembly 10 is illustrated in use in a partial cutaway of a building according to one of various embodiments of the invention. The position of platform assembly 10 has slide bar 52 positioned over studs 21 and/or wall 16 upon a head plate 23. The slide bar 52 extends into the building 12 between roofing rafters or trusses 20 and ceiling studs 28, and beneath ply board 22 of a roof. The clamp 54 of fastening device 49 is moved, adjusted or slide along the slide bar 52 to rest against stud 21 and/or head plate 23 (and/or wall 16) with connection extension 42 positioned adjacent or against the opposite side of stud 21 and/or head plate 23 (and/or wall 16). Clamp 54 is fixedly engaged to slide bar 52 by set pin set 63 (see FIGS. 7-9 and described subsequently) against head plate 23 to secure the inventive platform assembly 10 and platform support structure 30 to stud 21 and/or head plate 23 (and/or wall 16) and building 12 (see FIG. 1). In one exemplary embodiment of the invention, the abutment plate 50 and/or the connection extension 42 of platform support structure 30 rests against wall 16, or vertical studs 21.

Still referring to FIGS. 5-6, a plurality of platforms (floors or support surfaces) 66 are provided over platform plate 44 upon support extension 40. Alternatively, the plurality of platforms 66 rest upon support extension 40 if platform support structure 30 is devoid of platform plate 44. In this embodiment shown, four separate and distinct platforms 66 are provided. In one embodiment of the invention, platforms 66 rest upon platform plate 44 without fasteners or securement devices. Alternatively, platforms 66 are secured to platform plate 44 with fasteners such as rivets, screws, nails, etc. In this exemplary embodiment, the exemplary platform assembly 10 has rail posts 32 to include guard rails 70.

In another exemplary embodiment of the invention, an exemplary fastening device 49 includes a slide stop (not shown) at the end of slide bar 52 opposite joint 73 with connection extension 42. The slide stop (not shown) will prevent clamp 54 from sliding off slide bar 52. An exemplary embodiment of a slide stop (not shown) is a ridge extending upwardly from at least one planar side of slide bar 52.

Figures 8, 9, 10, 11:
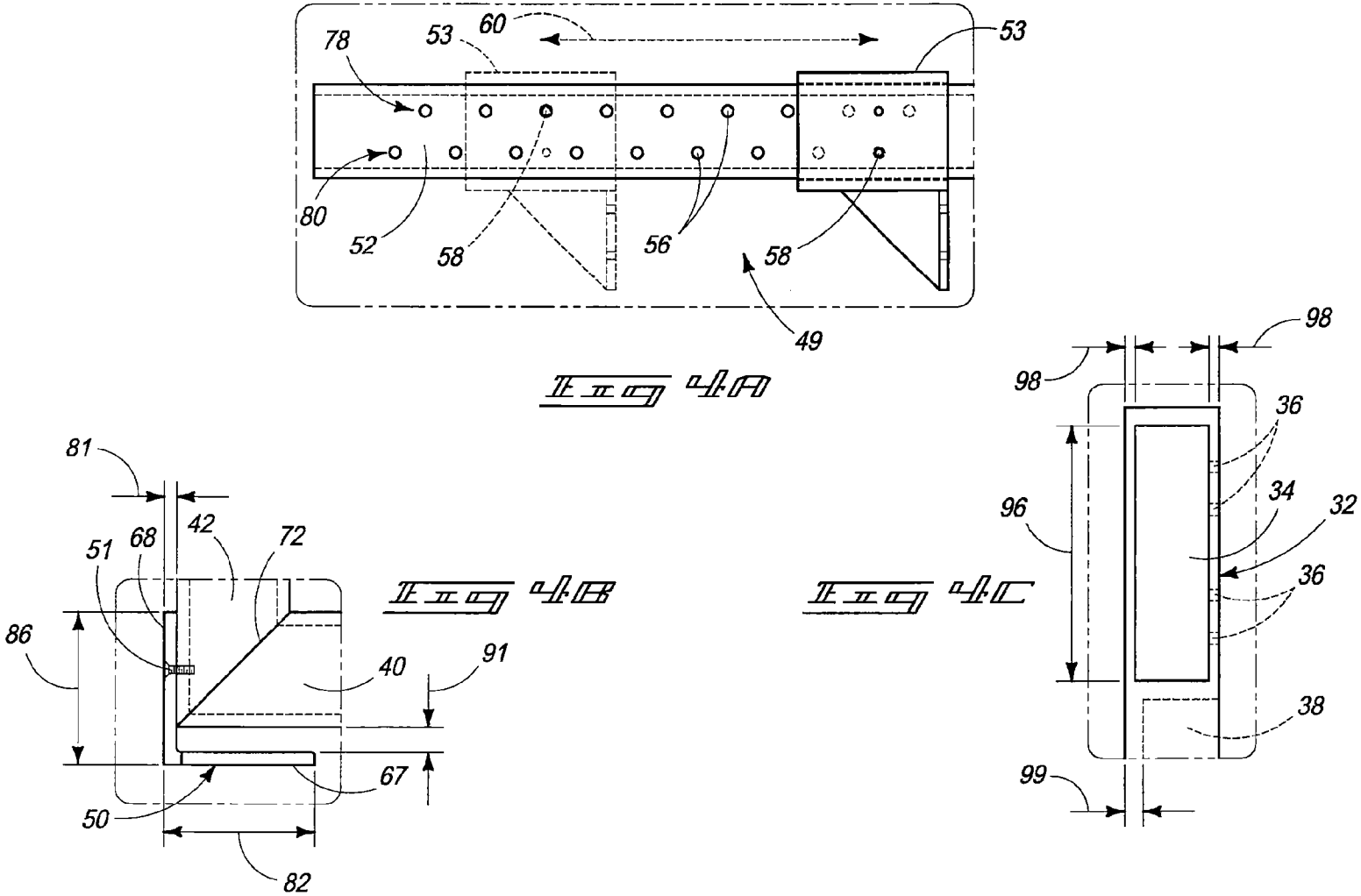
FIG. 8 is an elevational front view of an exemplary sliding structure for the clamp of the fastening device according to one of various embodiments of the invention.
FIG. 9 is a front view of an exemplary set pin/clip combination for the clamp of the fastening device according to one of various embodiments of the invention.
FIG. 10 is a top perspective view of an exemplary platform plate according to one of various embodiments of the invention.
FIG. 11 is a bottom perspective view of the platform plate of FIG. 10.
Figures 6, 7, 8:
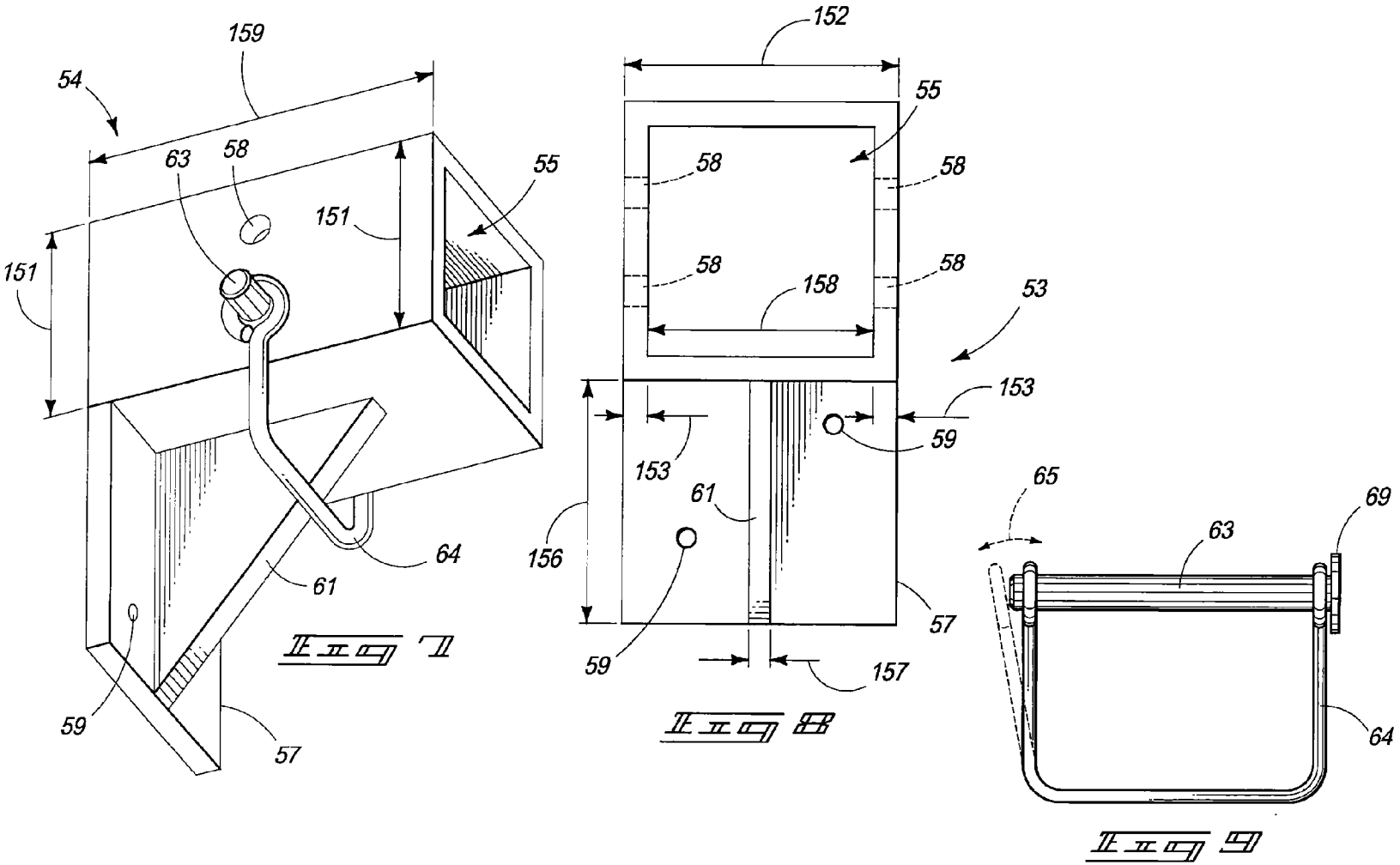
FIG. 7 is a perspective view of an exemplary clamp of the fastening device according to one of various embodiments of the invention.
Figure 11:
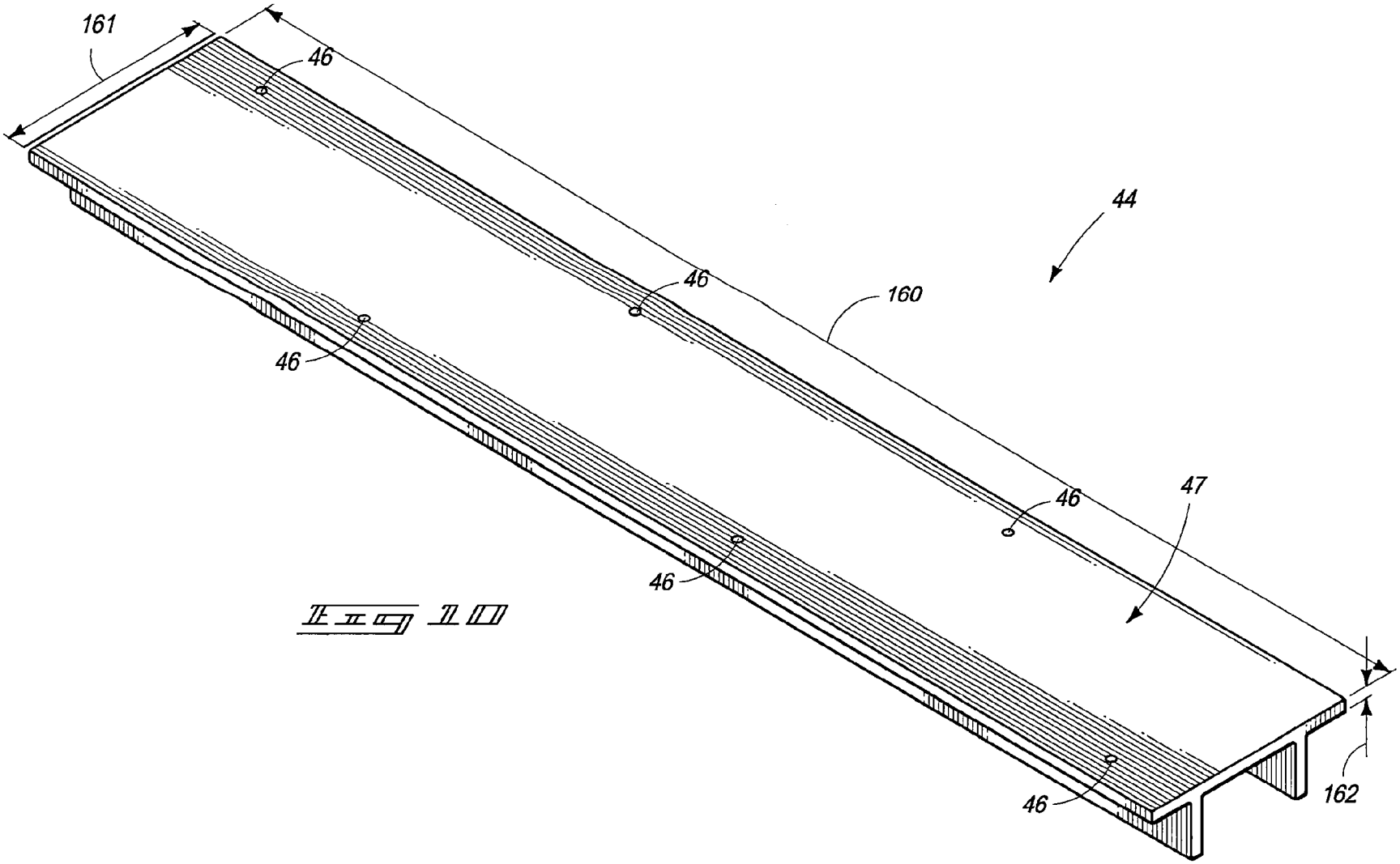
Figure 11:
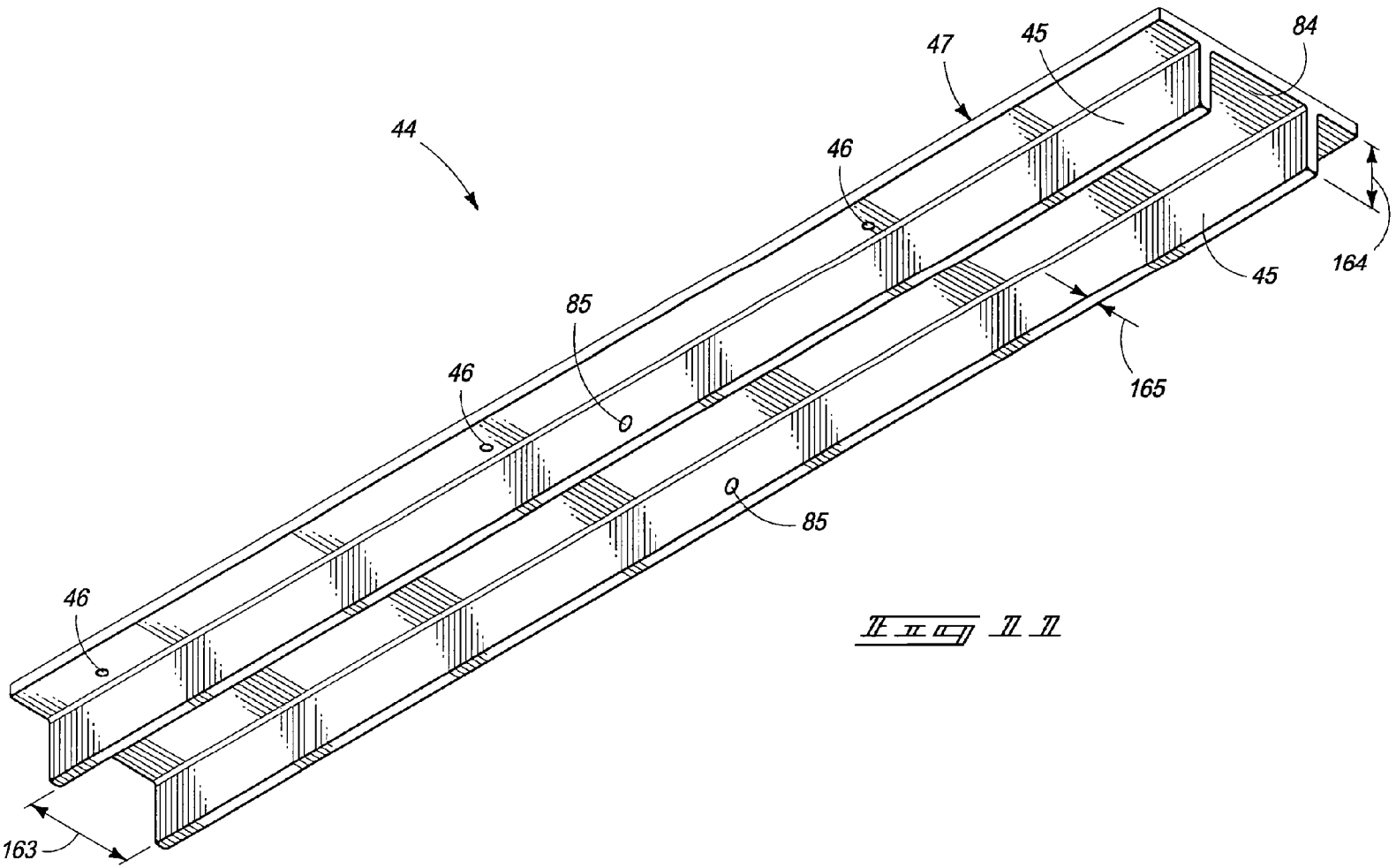
Figure 11:
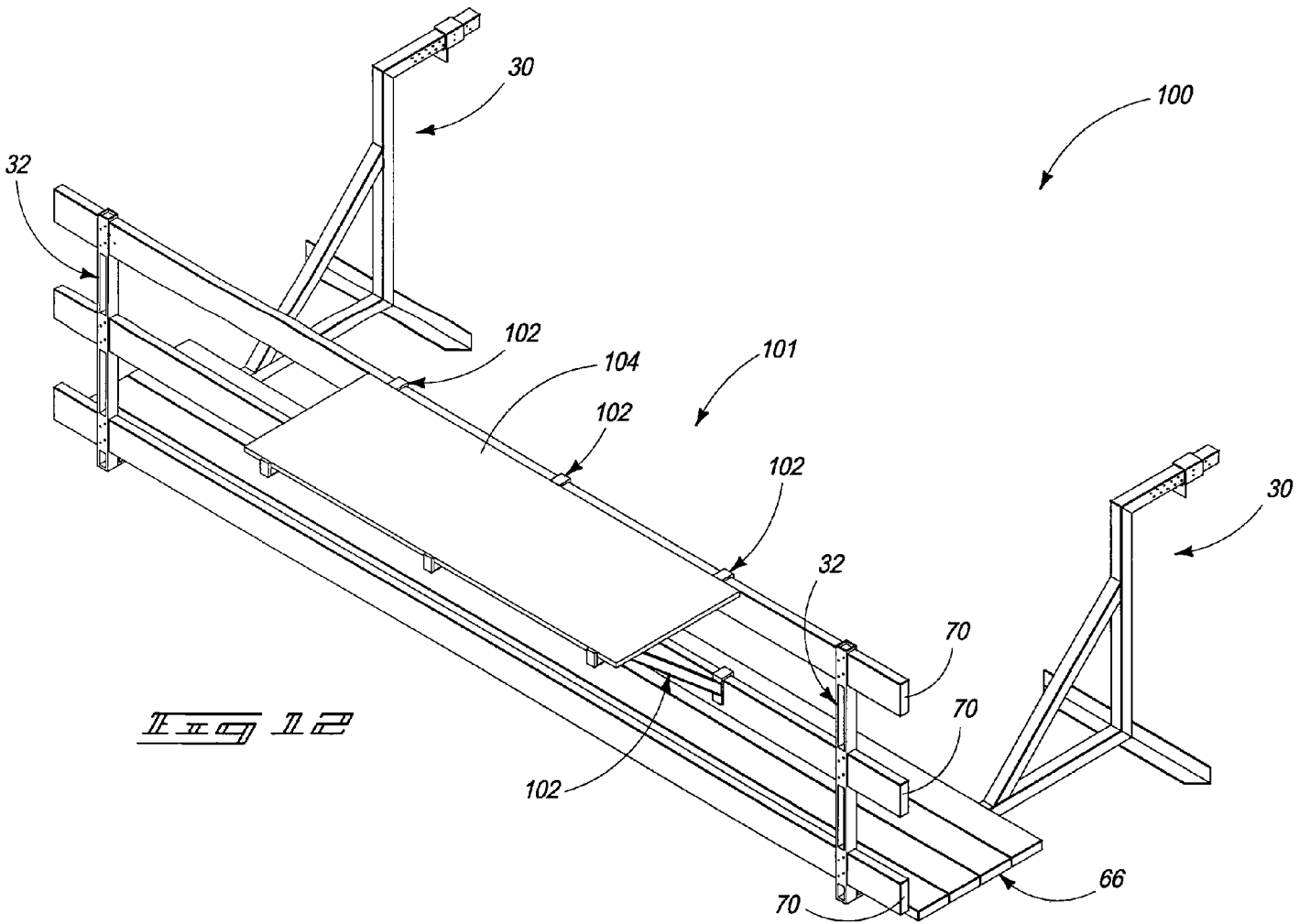
Figures 8, 9, 10, 11:
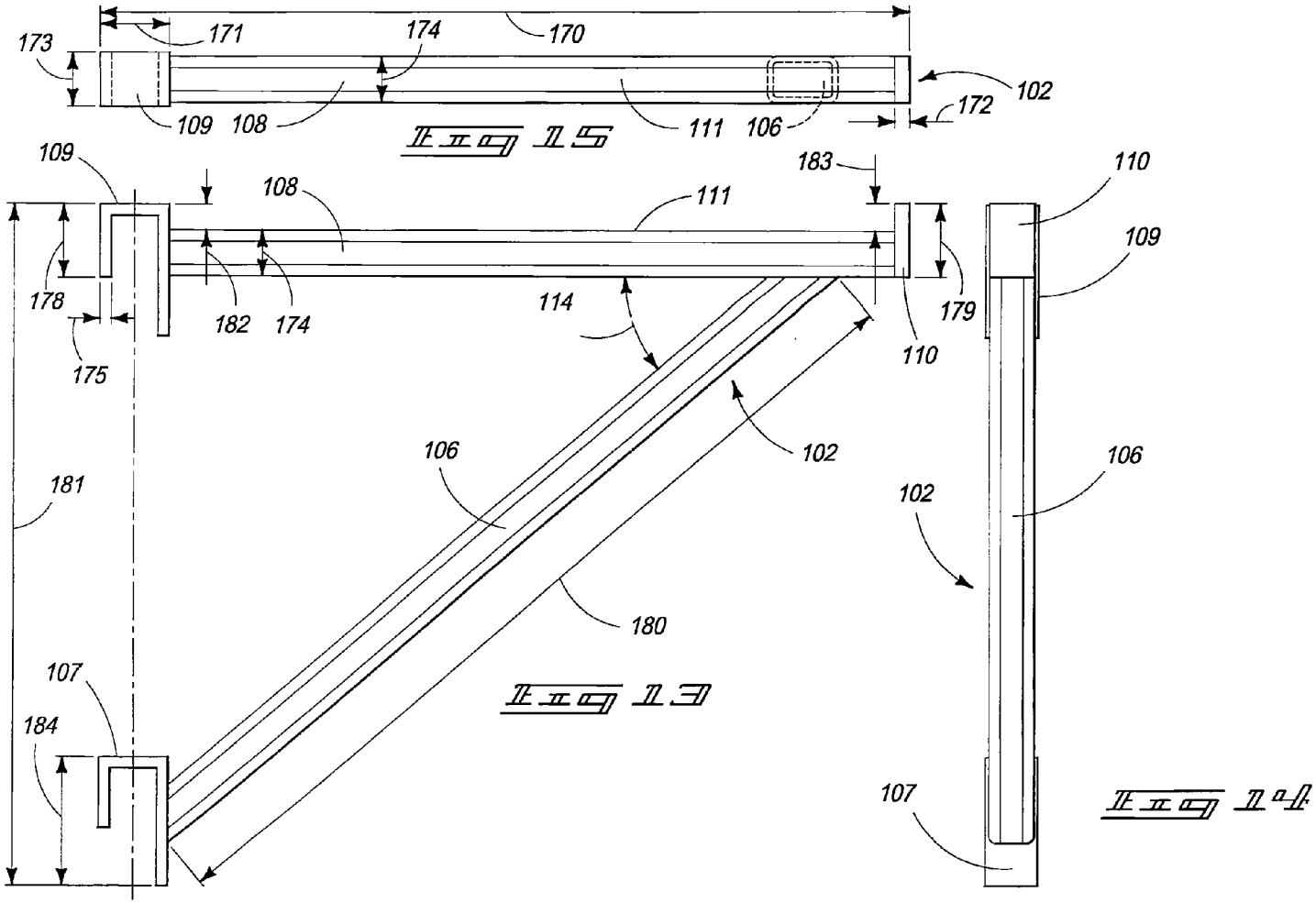
Figure 11:
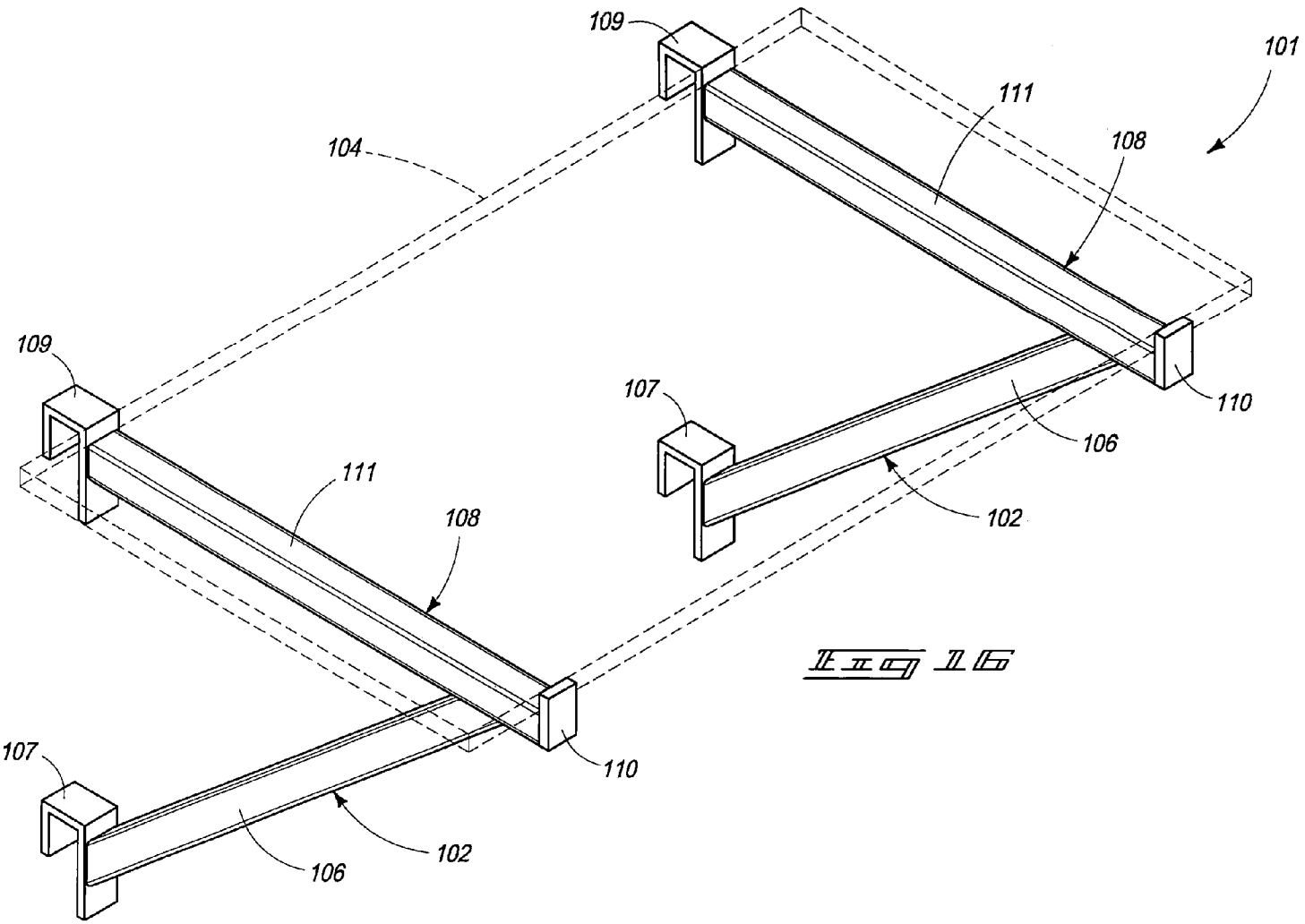
Figure 11:
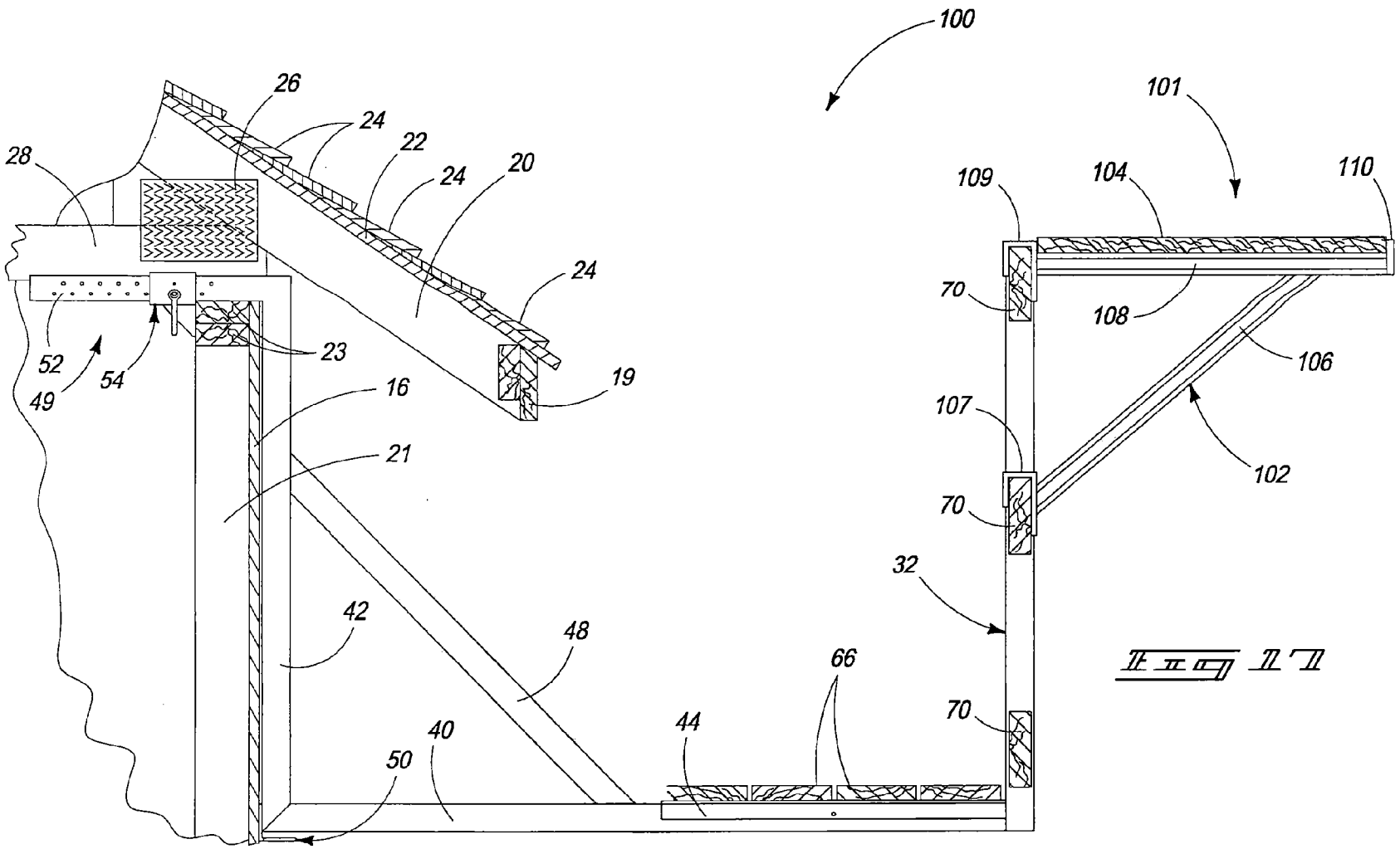
Figure 11B:
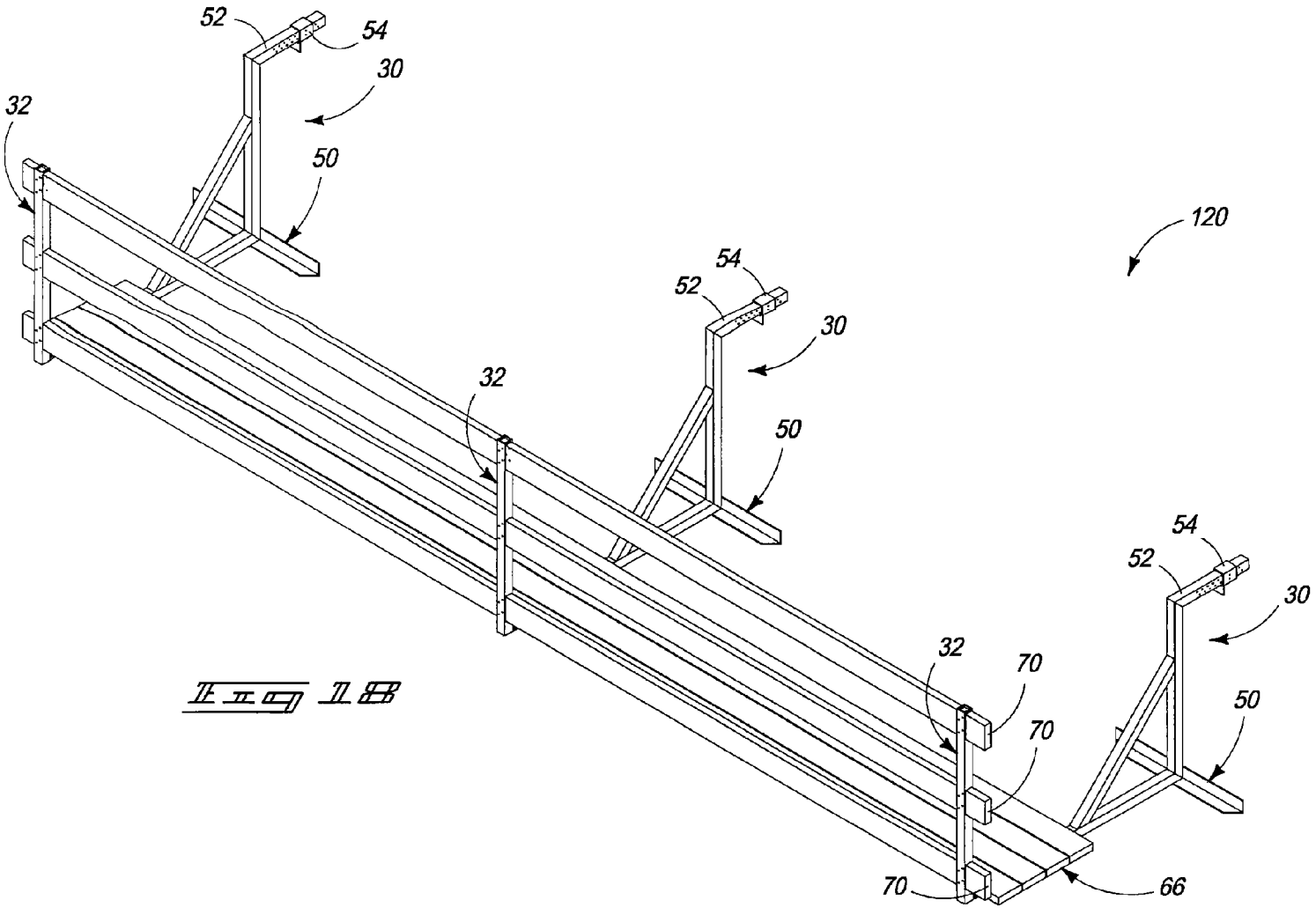
Figure 11:
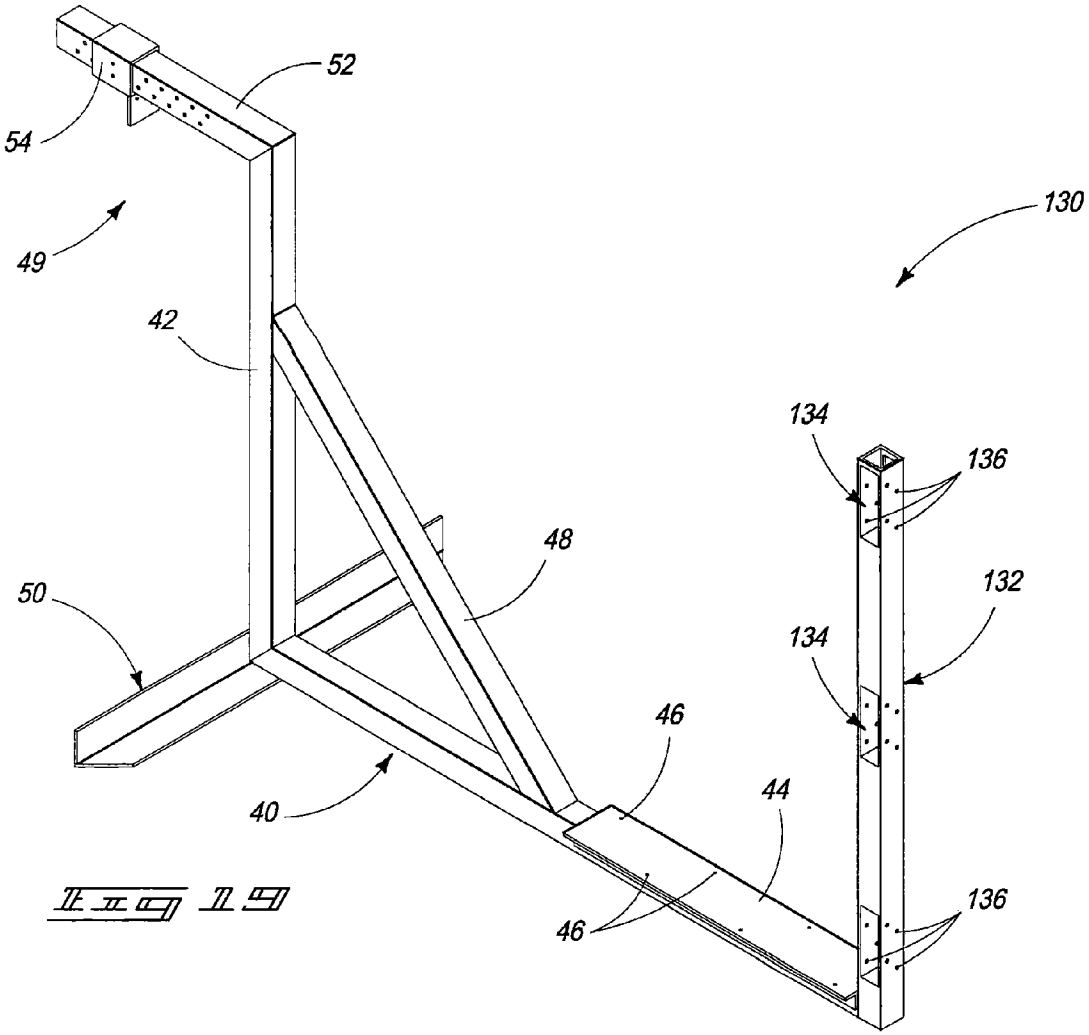

Referring to FIGS. 7-9, an exemplary embodiment of the fastening device 49 according to the invention is more thoroughly described. As stated previously, the fastening device 49 fixedly engages the platform assembly 10 and platform support structure 30 to a structure such as a wall 16. Clamp 54 slides upon slide bar 52 against wall 16 (or stud 21 and/or head plate 23). Clamp 54 includes a sliding structure 53, a set pin 63 and a u-shaped clip 64. An exemplary sliding structure 53 includes a hollow, tubular portion with an opening 55. Sliding structure 53 further includes a clamping plate 57 extending from one end of the tubular portion and a triangular brace 61 supporting and reinforcing the clamping plate 57 relative the tubular portion. The opening 55 of sliding structure 53 has a cross section configured to match the outer cross-sectional configuration and dimensions of slide bar 52 for a snug, but easy, sliding engagement over the outer periphery of slide bar 52. One exemplary embodiment of opening 55 for clamp 54 has a cross section that is square. Clamping plate 57 is configured as a rectangular or square planar plate and includes securement openings 59. Securement openings 59 are optionally used to receive fasteners, such as screws, nails, rivets, etc., to secure clamp 54 to studs 21 (and/or head plate 23 and/or wall 16). Respective apertures 58 of sliding structure 53 are aligned in opposite sides of the tubular portion.

Still referring to FIGS. 7-9, the exemplary fastening device 49 includes the set pin 63 having a head 69 at one end. The set pin 63 has a diameter configured to be received in apertures 58 of sliding structure 53 and in adjustment openings 56 of slide bar 52. Once the set pin 63 is provided in apertures 58 and adjustment openings 56, the sliding structure 53 is affixed in stationary position on the slide bar 52 of the fastening device 49. The head 69 of set pin 63 has a diameter that is larger than the diameters of apertures 58 of clamp 54 and adjustment openings 56 of slide bar 52 to act as a stop. That is, this configuration of head 69 prevents the set pin 63 from sliding entirely through the sliding structure 53 and the slide bar 52 when the set pin 63 is provided in openings 56 and apertures 58. The exemplary set pin 63 is provided with a u-shaped clip 64 configured with opposite ends having openings and each opening has a diameter configured to receive over set pin 63. Again, the head 69 of set pin 63 acts a stop for the u-shaped clip 64. One end of u-shaped clip 64 is capable of being flexed along reciprocal direction arrow 65 to be provided selectively on and off set pin 63.

Still referring to FIGS. 7-9, an exemplary method of securing or affixing a platform assembly 10 to a structure, such as wall 16, is described using the fastening device 49 according to an embodiment of the invention. The fastening device 49 is provided over and adjacent one side of wall 16. The balance of the platform assembly 10 structure is adjacent the side of wall 16 opposite the fastening device 49. The sliding structure 53 is moved along the sliding bar 52 until the clamping plate 57 rests adjacent or against wall 16. In this position, the sliding structure 53 is finely adjusted on sliding bar 52 until at least one corresponding pair of apertures 58 of sliding structure 53 is aligned with a pair of corresponding adjustment opening 56 of slide bar 52. The opposite ends of the u-shaped clip 64 are positioned on opposite sides of sliding structure 53 with the openings of clip 64 aligned with the aligned pair of apertures 58 which are aligned with the pair of adjustment opening 56. The set pin 63 is provided in aligned openings of clip 64, apertures 58, and adjustment openings 56. The set pin 63 is pushed through the one set of respective openings/apertures until the head 69 rests against the clip 64. Additionally, as the set pin progresses, the opposite end of the set pin 63 extends through the opposite set of respective openings/apertures and is exposed outward of an opposite side of clamp 54. In this configuration, the set pin 63 is affixed in respective openings/apertures by clip 64 and clamp 54 is affixed to the specific position on the sliding bar 52 by set pin 63 which ultimately affixes platform assembly 10 to wall 16.

Still referring to FIGS. 7-9, exemplary dimensions are disclosed for one exemplary embodiment of clamp 54 and sliding structure 53. The exemplary hollow, tubular portion of sliding structure 53 has an exemplary square cross section wherein the outermost dimension include a width dimension 152 and a height dimension 151 which equal approximately 2 13/16 inches. An exemplary length dimension 159 of the hollow, tubular portion of sliding structure 53 is approximately 3 7/10 inches. An exemplary opening 55 has a square configuration with each exemplary periphery inside dimension 158 being approximately 2 5/16 inches. The exemplary thickness dimension 153 for the exemplary hollow, tubular portion of sliding structure 53 is approximately ¼ inch. The clamping plate 57 extending from one end of the tubular portion has an exemplary length dimension 156 of approximately 2.¾ inches. The triangular brace 61 supporting and reinforcing the clamping plate 57 relative the tubular portion has an exemplary thickness dimension 157 of approximately ¼ inch.

Referring to FIGS. 10-11, an exemplary embodiment of a platform plate 44 has an upper surface plate 47 which is generally a rectangular, planar plate used to receive platform 66. Openings 46 in upper surface plate 47 are provided to receive fasteners (not shown) to secure and attach platform 66 to upper surface plate 47. Exemplary fasteners include bolts, rivets, nails, screws and any of the various combinations of the fasteners. For other embodiments of the invention, platform 66 can rest upon upper surface plate 47 without securement. In still other embodiments, platform 66 is welded to upper surface plate 47. In one embodiment of platform plate 44, more than the six openings 46 are provided in upper surface plate 47, and alternatively, less than the six openings 46 are provided. Openings 46 can be provided in different locations than those shown in FIGS. 10-11.

Still referring to FIGS. 10-11, and particularly FIG. 11, an exemplary embodiment of platform plate 44 has a pair of spaced attachment runners 45 extending generally perpendicularly from a bottom surface 84 of upper surface plate 47. That is, respective attachment runners 45 are parallel to each other. It should be understood that exemplary attachment runners 45 can extend the length of upper surface plate 47, and alternatively, can be dimensioned greater than or less than the length of upper surface plate 47. Openings 85 in attachment runners 45 are provided to receive fasteners (not shown) to secure and attach platform plate 44 to support extension 40 of platform support structure 30. Exemplary fasteners include bolts, rivets, nails, screws and any of the various combinations of the fasteners. In alternative embodiments, platform plate 44 is welded to support extension 40 of platform support structure 30. In one embodiment of platform plate 44, more than the two openings 85 are provided in attachment runners 45. Additionally, openings 85 can be provided in different locations than those shown in FIGS. 10-11.

Still referring to FIGS. 10-11, exemplary dimensions are disclosed for one exemplary embodiment of platform plate 44. An exemplary length dimension 160 for upper surface plate 47 of platform plate 44 is approximately 27 8/10 inches. An exemplary width dimension 161 for upper surface plate 47 of platform plate 44 is approximately 4¾ inches. An exemplary thickness dimension 162 for upper surface plate 47 of platform plate 44 is approximately ¼ inch. An exemplary width dimension 164 for attachment runners 45 (dimension measured from bottom surface 84 of upper surface plate 47) of platform plate 44 is approximately 1¼ inches. An exemplary distance or spacing dimension 163 between respective attachment runners 45 is approximately 2 5/16 inches. An exemplary thickness dimension 165 for attachment runners 45 of platform plate 44 is approximately ¼ inch.

It should be understood that various components of any exemplary platform support structures 30 described in this document (not including the Background of the Invention section) can include tubing of any cross-sectional configuration. That is, at least one of support extension 40, connection extension 42, slide bar 52 and angled brace 48 can include hollow tubing of any cross-sectional configuration. Alternatively, any combination of support extension 40, connection extension 42, slide bar 52 and angled brace 48 can include hollow tubing of any cross-sectional configuration. Moreover, it should be understood that other embodiments of the exemplary components of platform support structures 30 can have solid cross-sectional configurations. Furthermore, it should be understood that exemplary components of platform support structures 30, whether solid or hollow, can have cross-sectional configurations such as square, circular, diamond, rectangular, hexagonal, oval, any desired polygonal shape, and any various combination thereof.

Referring to FIG. 12, another exemplary platform assembly 100 is illustrated according to another of various embodiments of the invention. It should be understood that where reference numerals for structures and components that were previously described for previous embodiments of the invention exist in platform assembly 100, the same reference numerals will be used for the same structures and components without further discussion of same. In this exemplary embodiment, platform assembly 100 includes a table assembly 101. In one exemplary embodiment, table assembly 101 is supported upon guard rails 70. An exemplary table assembly 101 includes a table 104 supported by table supports 102 upon guard rails 70. In various different embodiments, table assembly 101, includes a pair of table supports 102, and alternatively, three or more table supports 102. In this embodiment, table 104 includes generally a smooth, planar and rectangular upper surface. Alternative shaped configurations are possible for table 104, for example, square, oval, circular, diamond or any other polygonal shape. Additionally, alternative surface configurations are possible, such as a rough surface. An exemplary rough surface includes a perforated surface, a surface with ridges, a surface with divots, and any rough surface to provide surface friction and traction, and any combination of these surface configurations.

Various different embodiments of the table assembly 101 includes the table supports 102 supported upon only one guard rail 70, alternatively upon only two guard rails 70, and further alternatively upon three or more guard rails 70. In one exemplary embodiment of the platform assembly 100, the table assembly 101 extends outwardly from rail posts 70 opposite from platform 66. In other embodiments of platform assembly 100, the table assembly 101 extends outwardly from rail posts 70 in the same direction as platform 66, and therefore, table assembly 101 is elevationally above platform 66. Moreover, it should be understood that table assembly 101 can include a single structure in its entirety as shown. Alternatively, table assembly 101 can include two or more discrete and separate structures such as planks of lumber discussed for platform 66.

Referring to FIGS. 13-15, an exemplary table support 102 is illustrated in a side view, front view and top view, respectively. The exemplary table support 102 includes a table rest 108 and table braces 106 extending from a bottom portion of table rest 108 at an angle 114. An exemplary angle 114 equals 40 degrees, and alternatively, angle 114 equals any angle in a range of from about 20 degrees to about 75 degrees. An exemplary table rest 108 is a linear structure having a table stop 110 at one end and having a first c-bracket 109 at the opposite end. An exemplary table brace 106 is a linear structure connected to the table rest 108 at one end and having a second c-bracket 107 at the opposite end. An exemplary table rest 108 and table brace 106 have similar cross-sectional configurations, for example, tubular with each outer corner being planed. That is, the cross-sectional configuration of table rest 108 and table brace 106 is of an octagon. Other cross-sectional configurations are possible and include geometric shapes other than octagon, for example, oval, diamond, square, rectangular and any polygonal shape. The first and second c-brackets 109 and 107 are received over top portions of different guard rails 70.

Still referring to FIGS. 13-15, exemplary dimensions are disclosed for one exemplary embodiment of table support 102. An exemplary entire length dimension 170 of table support 102 from the top view is approximately 26 13/16 inches. The first and second exemplary c-brackets 109 and 107 have in one embodiment the same dimensions. An exemplary length dimension 171 for the first and second exemplary c-brackets 109 and 107 is approximately 2½ inches. An exemplary width dimension 173 for the first and second exemplary c-brackets 109 and 107 is approximately 1¾ inches. An exemplary width dimension 174 for table rest 108 of table support 102 is approximately 1½ inches. An exemplary length dimension 172 for table stop 110 of table support 102 is approximately ⅜ inch.

Referring to FIG. 13, an exemplary maximum height dimension 181 of table support 102 from the side view is approximately 22⅜ inches. An exemplary rearmost height dimension 178 of the first and second exemplary c-brackets 109 and 107 is approximately 2⅜ inches. An exemplary front-most height dimension 178 of the first and second exemplary c-brackets 109 and 107 is approximately 3⅞ inches. An exemplary thickness dimension 175 of the first and second exemplary c-brackets 109 and 107 is approximately ⅜ inch. An uppermost surface of first bracket 109 is elevationally above an upper surface 111 of table rest 108 at a distance 182 of approximately 13/16 inch. An exemplary height dimension 179 of table stop 110 is approximately 2⅜ inches. An uppermost surface of table stop 110 is elevationally above the upper surface 111 of table rest 108 at a distance 183 of approximately ⅞ inch. An exemplary length dimension 180 for table brace 106 of table support 102 is approximately 29 inches.

Referring to FIG. 16, the table rest 108 of table support 102 includes the upper surface 111 to receive table 104. Moreover, the table stop 110 of table rest 108 prevents table 104 from sliding off the upper surface 111 at the front end of table support 102. Additionally, upper portion of c-bracket 109 of table support 102 extends elevationally above upper surface 111, and therefore, prevents table 104 from sliding off the upper surface 111 at the rear end of table support 102.

Referring to FIG. 17, the platform assembly 100 is illustrated in use in a partial cutaway of a building according to one of various embodiments of the invention. Platform assembly 100 is secured to the building by fastening device 49 in the same manner as previously described. Furthermore, table assembly 101 is supported upon guard rails 70 in rail posts 32 of platform assembly 100. In this exemplary embodiment, table 104 extends outwardly from platform assembly 100 away from the building.

Referring to FIG. 18, another exemplary platform assembly 120 is illustrated according to another of various embodiments of the invention. It should be understood that where reference numerals for structures and components that were previously described for previous embodiments of the invention exist in platform assembly 120, the same reference numerals will be used for the same structures and components without further discussion of same. In this embodiment, the exemplary platform assembly 120 has more than two platform support structures. In this exemplary embodiment, platform assembly 120 includes three platform support structures 30. Each one of the three guard rails 70 can be single structures that span the entire distance provided by the relative spacing of the three rail posts 32 of the three platform support structures 30. In this embodiment for guard rails 70, a center portion of each guard rail 70 would be supported by the centrally located platform support structures 30.

Alternatively, and still referring to FIG. 18, platform assembly 120 includes each one of guard rails 70 to be configured as two structures for a total of six structures. In this exemplary embodiment, each single structure of guard rails 70 would extend between only two of the three rail posts 32. That is, each end of guard rails 70 would rest in two, adjacently spaced platform support structures 30. Accordingly, the platform support structure 30 positioned in the middle has a rail post 32 with each rail socket 34 receiving respective ends of two guard rails 70. That is, the three rail sockets 34 in the rail post 32 of the middle platform support structure 30 will have received a total of six ends of the respective guard rails 70.

Referring to FIG. 19, another exemplary platform support structure 130 is illustrated according to another of various embodiments of the invention. It should be understood that where reference numerals for structures and components that were previously described for previous embodiments of the invention exist in platform support structure 130, the same reference numerals will be used for the same structures and components without further discussion of same. In this exemplary embodiment, platform support structure 130 has rail posts 132 that are devoid of openings 38 described and disclosed with previous embodiments of the invention, for example, as shown in FIGS. 3, 4 and 4C. The exemplary rail posts 132 have rail sockets 134 to receive guard rails 70 and have fastener openings 136 to secure the guard rails 70.

Figure 20:
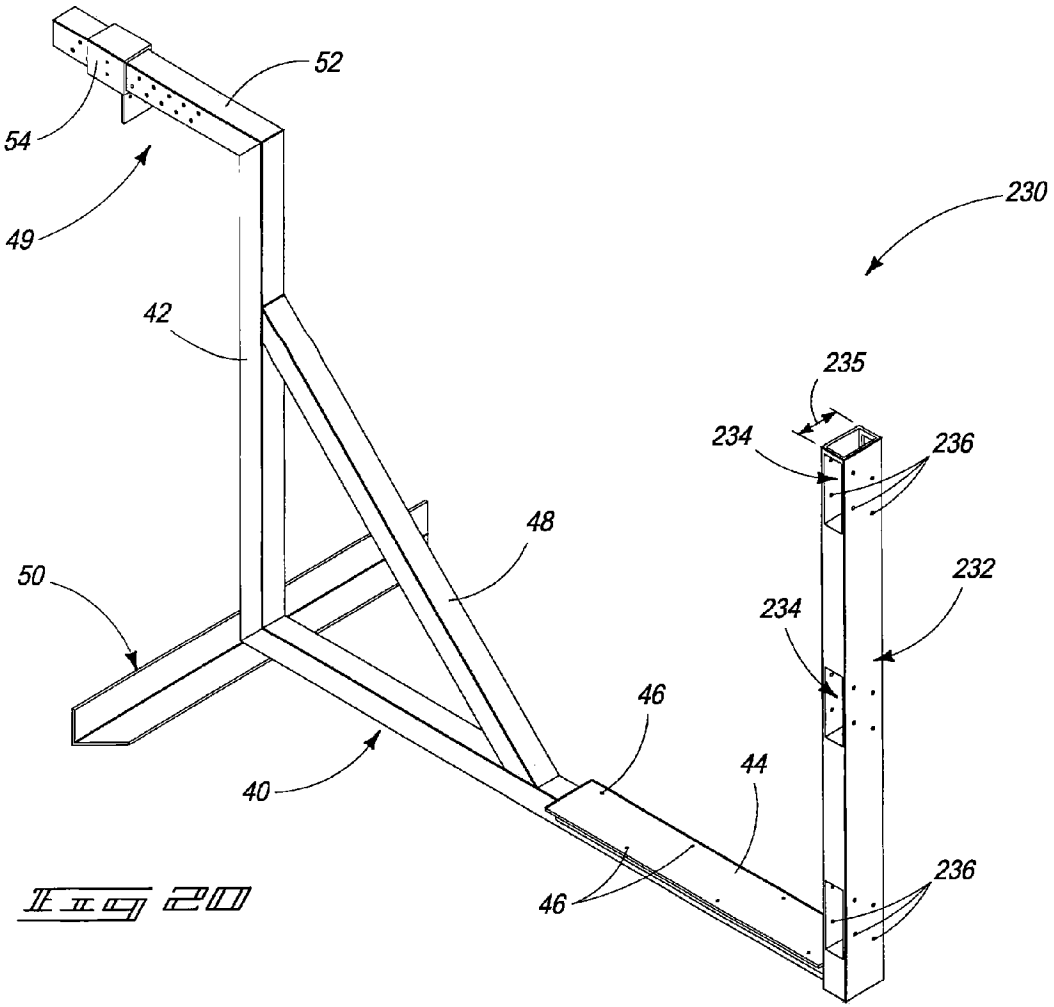
FIG. 20 is a perspective view of third exemplary platform support structure according to still another one of various embodiments of the invention.

Referring to FIG. 20, another exemplary platform support structure 230 is illustrated according to another of various embodiments of the invention. It should be understood that where reference numerals for structures and components that were previously described for previous embodiments of the invention exist in platform support structure 230, the same reference numerals will be used for the same structures and components without further discussion of same. In this exemplary embodiment, platform support structure 230 has a rail post 232 that has width dimensions 235 greater than the width dimensions of previously described platform support structures. The exemplary rail post 232 with the greater width dimensions will increase the length dimensions for rail sockets 234 to facilitate the receipt of guard rails 70.

For example, and still referring to FIG. 20, platform assembly 120 (FIG. 18) described previously can have platform support structure 230 provided in the middle between the other two platform support structures 30 at opposite ends. With the centrally located platform support structure 230 having rail post 232 with greater width dimensions 235, each rail socket 234 has a greater length to receive the two respective ends of guard rails 70. That is, for the embodiment where each one of guard rails 70 is configured as two structures for a total of six structures, each rail socket 234 of platform support structure 230 will receive the two ends of respective guard rails. The exemplary platform support structure 230 includes fastener openings 236 to secure the guard rails 70 to rail post 232. It should be understood that while the exemplary platform support structure 230 is devoid of openings 38 in rail post 232, other embodiments of platform support structure 230 would include openings 38 in rail post 232.

Figure 21:
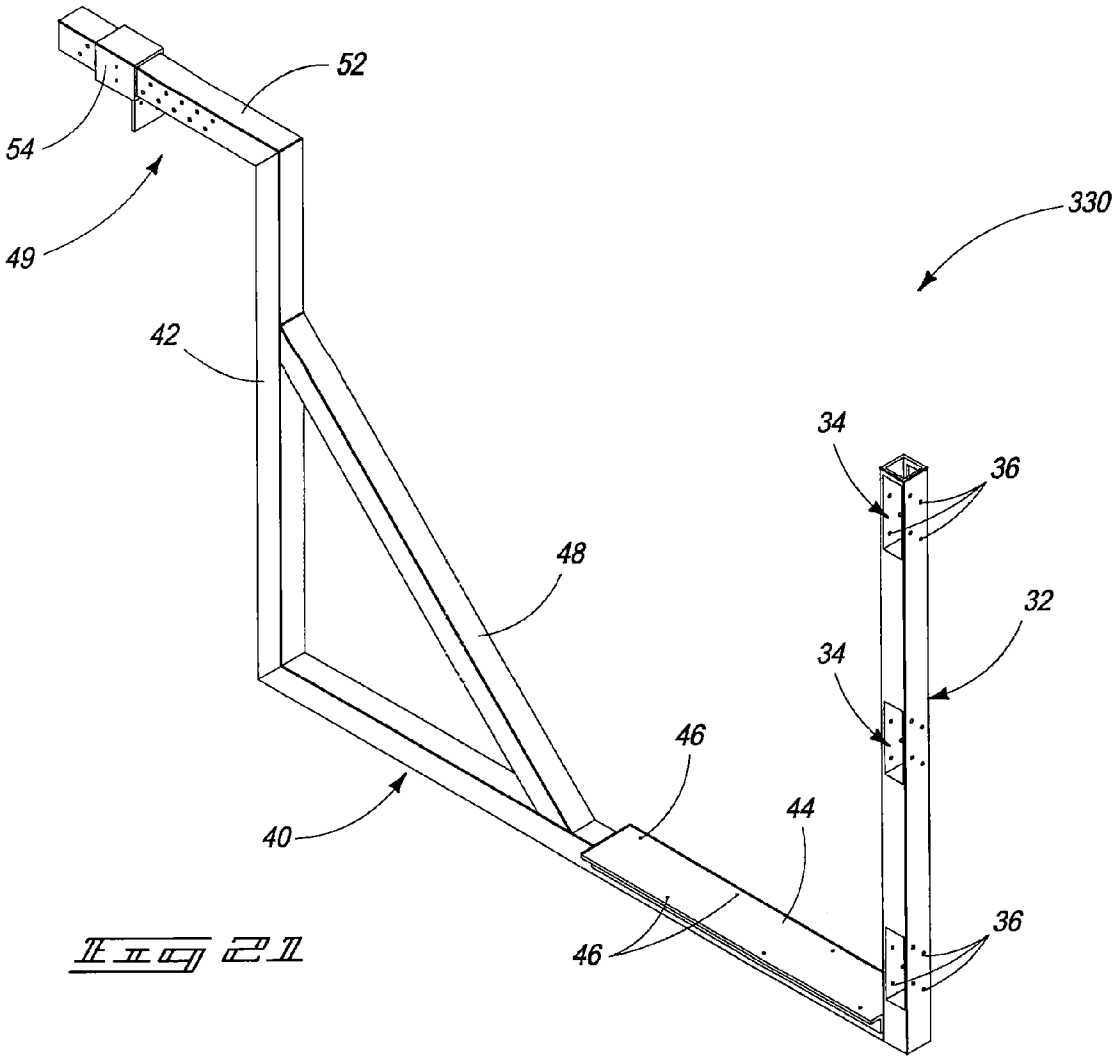
FIG. 21 is a perspective view of fourth exemplary platform support structure according to yet another one of various embodiments of the invention.

Referring to FIG. 21, another exemplary platform support structure 330 is illustrated according to another of various embodiments of the invention. It should be understood that where reference numerals for structures and components that were previously described for previous embodiments of the invention exist in platform support structure 330, the same reference numerals will be used for the same structures and components without further discussion of same. In this exemplary embodiment, platform support structure 330 is devoid of abutment plate 50 described and disclosed with previous embodiments of the invention, for example, as shown in FIGS. 2-4C and 10-11. It should be understood that while the exemplary platform support structure 330 is devoid of openings 38 in rail post 32, other embodiments of platform support structure 330 would include openings 38 in rail post 32.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

The invention claimed is:

1. A platform assembly comprising:

at least two platform support structures laterally spaced from each other, each platform support structure comprising:

a support extension comprising opposite ends and a surface between the opposite ends;

a fastening device extending from a first end of the support extension, the fastening device comprising a slide bar and a clamp slidingly engaging the slide bar, the slide bar comprising a side having a first row of openings and a second row of openings; and a rail post extending from a second end of the support extension opposite the first end; and a platform supported upon the surfaces of respective support extensions;

first and second guard rails supported upon respective rail posts; and a table supported upon a table rest, the table rest comprising a first arm supporting the table and having a c-bracket at one end supported upon the first guard rail, the c-bracket comprising a stop for the table, the table rest comprising a second arm angling down from the first arm, the second arm having a c-bracket supported upon the second guard rail below the first guard rail; and wherein the one end of the first arm with the c-bracket is devoid of an arm extending therefrom; and wherein the second arm intersects the first arm in between the one end and an opposite second end of the first arm, and each of the two rail posts comprises a width dimension that extends the entire length of the rail post, one of the two rail posts having a width dimension that is greater than a width dimension of the other of the two rail posts; and the support extension comprising opposite ends and supporting a platform plate configured to support at least a portion of a platform between the opposite ends, the platform plate comprising an upper surface having a first set of openings configured to receive fasteners to secure the portion of the platform to the platform plate, a longitudinal length of the platform plate extending along a longitudinal length of the support extension, wherein the support extension comprises a width dimension and wherein a spacing between the first set of openings in the platform plate comprises a dimension greater than the width dimension, the platform plate comprising a second set of openings configured to receive fasteners to secure the platform plate to the support extension.

2. The platform assembly of claim 1 wherein the guard rail comprises at least one of the following surface configurations: perforated surface, surface with divots, and any combination of these surface configurations.

3. The platform assembly of claim 1 wherein the table comprising at least one of the following surface configurations: perforated surface, surface with divots, and any combination of these surface configurations.

4. The platform assembly of claim 1 wherein the second arm is immovable.

5. The platform assembly of claim 1 wherein the second arm is non-extendible.

6. The platform assembly of claim 1 wherein the c-bracket of the first arm comprises a width slightly larger than a width of the first arm.

* * * * *